US010718565B2

(12) United States Patent
Hinkey

(10) Patent No.: US 10,718,565 B2
(45) Date of Patent: Jul. 21, 2020

(54) METHODS OF DRYING APPAREL AND APPAREL DRYING ASSEMBLIES

(71) Applicant: Lawrence A. Hinkey, Glens Falls, NY (US)

(72) Inventor: Lawrence A. Hinkey, Glens Falls, NY (US)

( * ) Notice: Subject to any disclaimer, the term of this patent is extended or adjusted under 35 U.S.C. 154(b) by 0 days.

(21) Appl. No.: 16/227,757

(22) Filed: Dec. 20, 2018

(65) Prior Publication Data

US 2019/0120551 A1 Apr. 25, 2019

Related U.S. Application Data

(63) Continuation-in-part of application No. 15/195,250, filed on Jun. 28, 2016, now Pat. No. 10,197,332.

(51) Int. Cl.
*F26B 9/00* (2006.01)
*F26B 21/00* (2006.01)

(52) U.S. Cl.
CPC ..... *F26B 9/00* (2013.01); *F26B 21/006* (2013.01)

(58) Field of Classification Search
CPC .. F26B 3/02; F26B 9/10; F26B 21/006; F26B 21/06; A43D 95/10; A43D 95/04; A47L 23/205; D06F 59/04; D06F 59/06
USPC ..... 34/90, 427
See application file for complete search history.

(56) References Cited

U.S. PATENT DOCUMENTS 1,074,888 A 10/1913 McIver
2,443,695 A 6/1948 Russell
2,668,368 A 12/1952 Jacobs
2,835,049 A 5/1958 Jacobs
3,508,664 A * 4/1970 Lessard ..... A47G 25/0657 211/89.01

(Continued)

FOREIGN PATENT DOCUMENTS

CA 2801681 A1 7/2013
DE 2852762 A1 6/1980

(Continued)

OTHER PUBLICATIONS

International Search Report from corresponding PCT application PCT/US2017/039501, dated Aug. 6, 2017, 4 pages.

(Continued)

*Primary Examiner* — Stephen M Gravini
(74) *Attorney, Agent, or Firm* — Tech Valley Patent, LLC; John Pietrangelo

(57) ABSTRACT

Assemblies and methods for drying apparel, for example, footwear or gloves, are provided. The assemblies include a panel; projections or pegs pivotally mounted to the panel, the projections each having an inlet, an outlet, an internal passage communicating the inlet to the outlet, and the projections can be oriented in a position adapted to receive the apparel; and a source of air having an outlet in fluid communication with the inlets of the projections. The air, for example, from a fan, passes into the inlets of the projections, through the internal passages, and out of the outlets to contact and dry the apparel mounted on the projections. The methods may include heating the air to enhance the drying. Projection modules that can be pivotally mounted to extend and retract into the panel are also disclosed. The retracted projection may be flush with the panel when not in use.

10 Claims, 18 Drawing Sheets

(56) References Cited

U.S. PATENT DOCUMENTS

| | | | | |
|---|---|---|---|---|
| 3,626,602 | A | 12/1971 | Glowacki | |
| 3,793,744 | A | 2/1974 | Saita | |
| 3,798,788 | A | 3/1974 | Kuntz | |
| 4,145,602 | A | 3/1979 | Lee | |
| 4,200,993 | A | 5/1980 | Blanc et al. | |
| 4,342,196 | A * | 8/1982 | Yeh | F03G 3/00 60/531 |
| 4,727,656 | A | 3/1988 | Jannach et al. | |
| 4,856,206 | A | 8/1989 | Klein | |
| 4,887,153 | A | 12/1989 | Uehara et al. | |
| D310,742 | S | 9/1990 | Johnson | |
| 5,199,188 | A | 4/1993 | Franz | |
| 5,222,308 | A | 6/1993 | Barker et al. | |
| 5,287,636 | A | 2/1994 | Lafleur et al. | |
| 5,394,619 | A | 3/1995 | Kaplan | |
| 5,412,928 | A | 5/1995 | Reithel | |
| 5,642,462 | A * | 6/1997 | Huff | A47K 10/06 211/105.1 |
| 5,778,556 | A | 7/1998 | Ohsugi | |
| 5,894,680 | A | 4/1999 | Dalvy | |
| 5,987,773 | A | 11/1999 | Lipscy | |
| 6,698,106 | B1 | 3/2004 | Reithel et al. | |
| 6,766,591 | B1 | 7/2004 | McKinney et al. | |
| 6,796,053 | B2 * | 9/2004 | Lurie | A47L 23/20 34/104 |
| 6,944,970 | B2 * | 9/2005 | Silverbrook | B41J 11/002 101/389.1 |
| 7,467,481 | B2 * | 12/2008 | Christian | A47L 23/205 34/104 |
| 8,100,275 | B2 * | 1/2012 | Trowsdale | D06F 57/08 211/195 |
| 8,322,541 | B2 | 12/2012 | MacLaren-Taylor | |
| 8,857,072 | B1 | 10/2014 | Cocker et al. | |
| 8,984,766 | B2 | 3/2015 | Williams | |
| 9,523,536 | B2 * | 12/2016 | Baek | F26B 25/18 |
| 9,609,970 | B2 | 4/2017 | Piraino | |
| 10,197,332 | B2 * | 2/2019 | Hinkey | F26B 21/006 |
| 2005/0204579 | A1 | 9/2005 | Rosseau et al. | |
| 2010/0031526 | A1 | 11/2010 | Tuckett | |
| 2013/0008045 | A1 | 1/2013 | McLoughlin et al. | |
| 2013/0199581 | A1 | 8/2013 | Christopherson | |
| 2017/0370647 | A1 | 12/2017 | Hinkey | |
| 2018/0105972 | A1 | 4/2018 | Smoots | |
| 2019/0120551 | A1 * | 4/2019 | Hinkey | F26B 9/00 |

FOREIGN PATENT DOCUMENTS

| | | | | |
|---|---|---|---|---|
| DE | 20215507 | U1 | 3/2003 | |
| DE | 20215507 | U1 | 6/2003 | |
| EP | 180530 | A1 | 5/1986 | |
| FR | 2199452 | A1 | 4/1974 | |
| KR | 20120087628 | A * | 8/2012 | D06F 58/00 |
| WO | 2006082487 | A1 | 1/2006 | |
| WO | WO-2008128279 | A1 * | 10/2008 | D06F 58/10 |
| WO | WO-2012102465 | A2 * | 8/2012 | D06F 58/00 |
| WO | WO-2012102465 | A3 * | 9/2012 | F26B 25/18 |

OTHER PUBLICATIONS

Written Opinion from corresponding PCT application PCT/US2017/039501, dated Aug. 6, 2017, 8 pages.

Wiliams Boot Dryers. Datasheet [online]. Williams, date unknown. [retrieved on Feb. 22, 2018] Retrieved from the Internet: <URL: http://www.seaproductsonline.com/WilliamsBootDryers.htmll>.

GearDryer Boot Dryers. Datasheet [online]. GearDryer, date unknown. [retrieved on Feb. 22, 2018] Retrieved from the Internet: <URL: http://www.seaproductsonline.com/GearDryer.html>.

Wintersteiger Boot Dryers. Datasheet [online]. Wintersteiger, date unknown. [retrieved on Feb. 22, 2018] Retrieved from the Internet: <URL: https://www.wintersteiger.com/us/Drying-and-Hygienic/Products/Product-Range/Open-drying-systems-in-steel-Boot-dryer-glove-dryer/206-Boot-51020I>.

Office Action for parent U.S. Appl. No. 15/159,250 dated Jun. 20, 2018, including Notice of References cited, 8pp.

Seha, Patrick, "Piano Coat Rack," 2pp., Brochure [online]. Seha, date unknown. [retrieved on Jun. 28, 2016] Retrieved from the Internet: <URL: https://www.smow.de/pdf/PerUse_Piano_1.pdf>.

BK Blower Manual, 108998-01, Rev. F, 8pp, Feb. 2007.

Cyclone boot dryers, 3pp., Brochure [online].Cyclone, date unknown. [retrieved on Jun. 21, 2016] Retrieved from the Internet: <URL: http://www.cyclonebootdryers.com>.

Cozywinters boot dryers, 4pp., Brochure [online]. Cozywinters, date unknown. [retrieved on Jun. 21, 2016] Retrieved from the Internet: <URL: http://cozywinters.com/boot-dryers.html>.

* cited by examiner

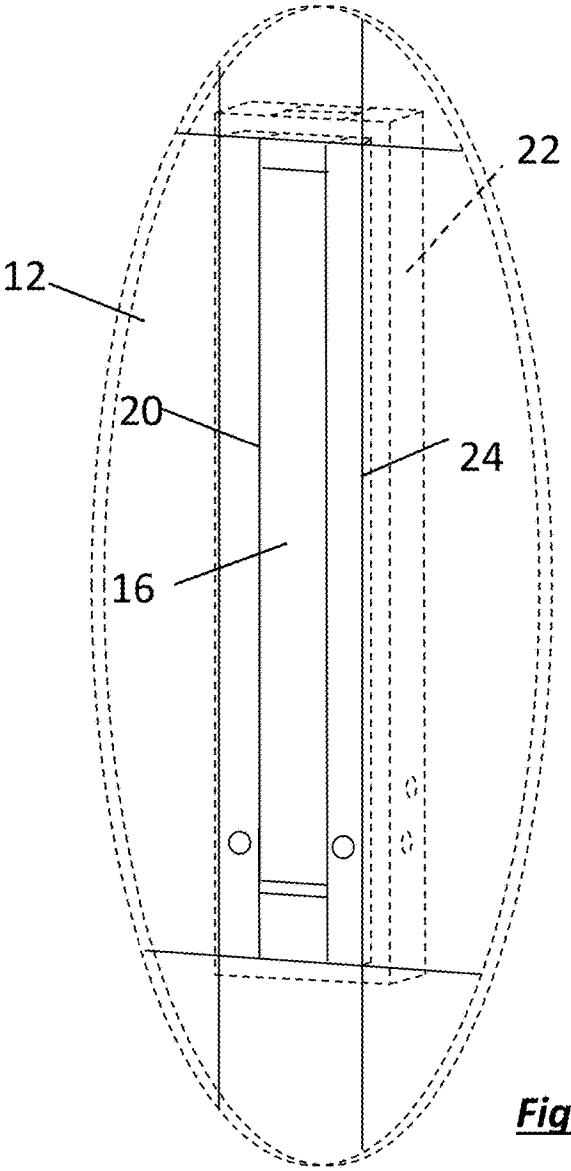
Figure 4
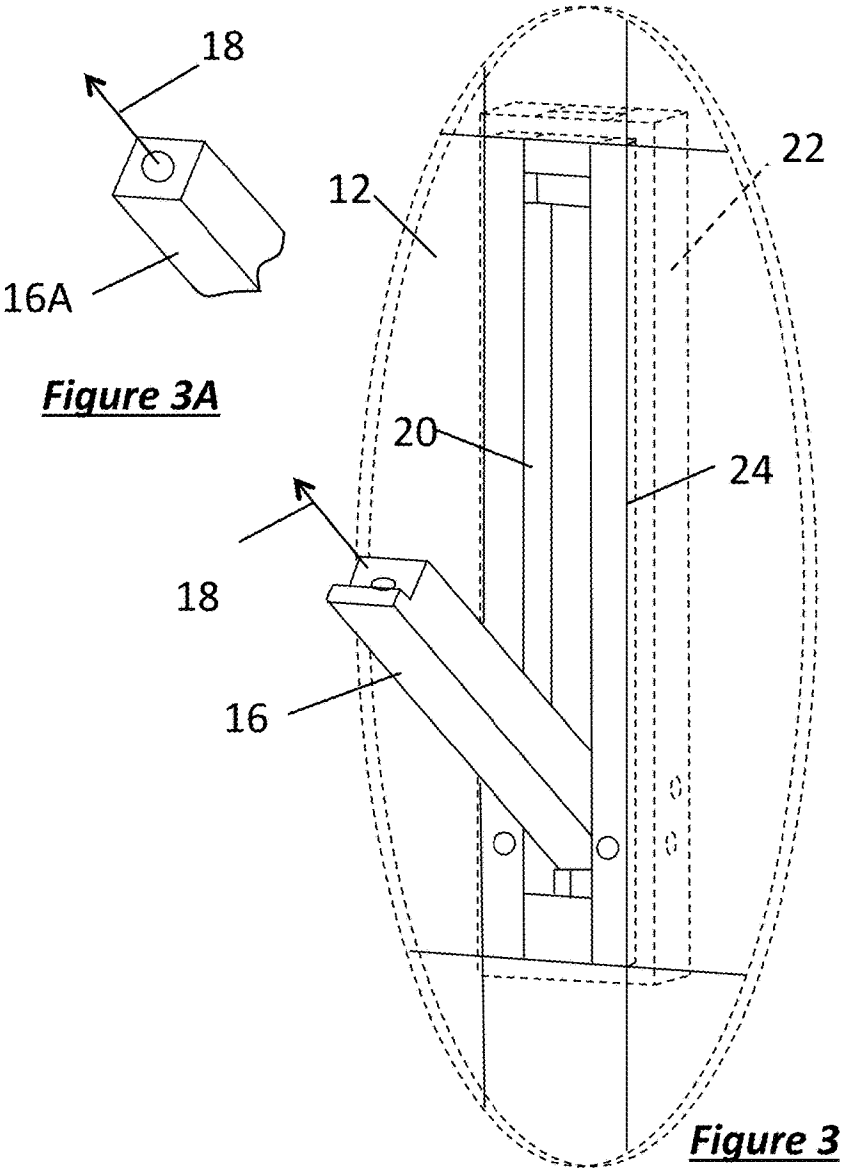
Figure 3
Figure 3A

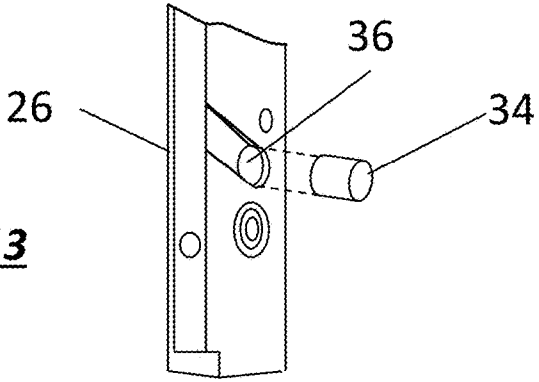
Figure 13
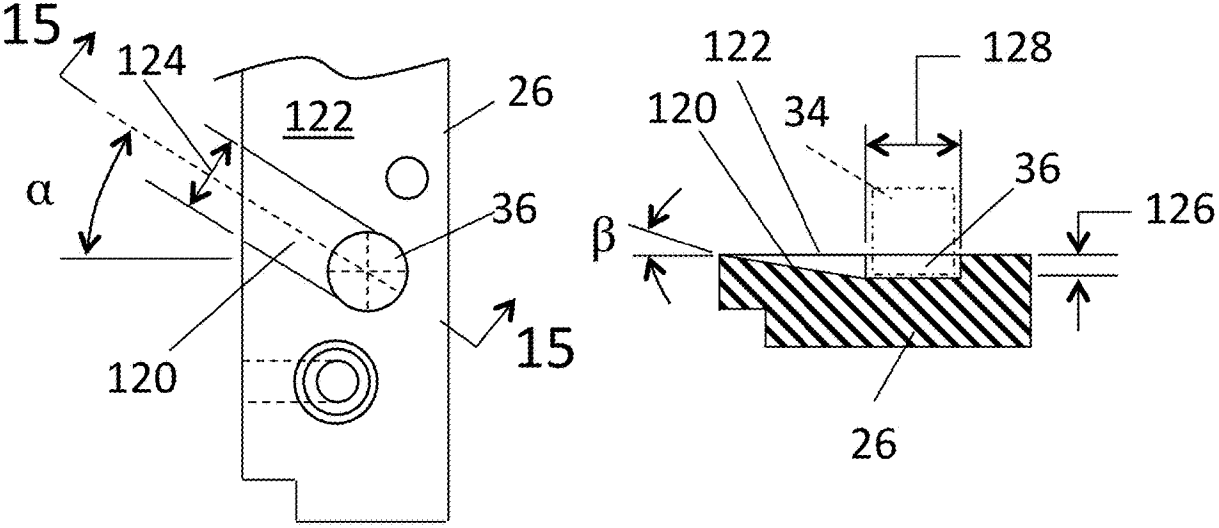
Figure 14
Figure 15
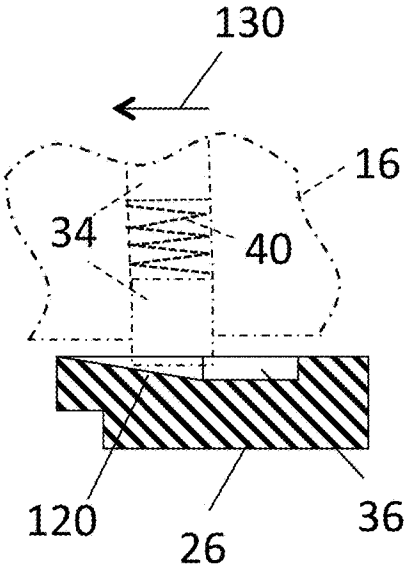
Figure 16

180
γ
184
182
190
192
δ
23

180
22
188
184
182
178
190
194
192
186

192
193

180
190
184
194
182
192

180
182
188

METHODS OF DRYING APPAREL AND APPAREL DRYING ASSEMBLIES

CROSS-REFERENCE TO RELATED APPLICATION

This application is a continuation-in-part application and claims priority from U.S. application Ser. No. 15/195,250 filed on Jun. 28, 2016, now U.S. Pat. No. 10,197,332, the disclosure of which is included by reference herein in its entirety.

BACKGROUND OF THE INVENTION

Technical Field

The present invention concerns apparel drying, for example, the drying of footwear and hand wear. Specifically, aspects of the invention provide drying assemblies and methods employing wall-mounted panels having pivotally mounted projections adapted to emit a flow of drying air to apparel hung on the projections.

Description of Related Art

Wet clothing, especially, wet footwear, is a common irritation and inconvenience to most, in particular to mothers and skiers. Waiting for footwear or clothing to dry for re-use or storage can hamper outdoor activity or prevent timely access to recreational opportunities and commercial enterprises. Accordingly, many attempts have been made in the art to facilitate the drying of apparel. However, prior art attempts have typically included cumbersome devices and methods that, for example, do not lend themselves to the décor or environment typically desired in a home, office, or resort.

For example, U.S. Pat. No. 3,793,744 discloses a wall-mounted rack for drying shoes having conduits and rigidly mounted extensions for distributing air. U.S. Pat. No. 4,200,993 discloses a tower for drying ski boots having a vertical plenum and rigidly mounted tubes projecting from the plenum for distributing air to the boots. U.S. Pat. No. 5,287,636 discloses a shoe dryer having pivoting tubes that are inserted into the shoes to distribute hot air. PCT Publication WO 2006/082487 discloses a wall-mounted boot dryer having projections that rotate when loaded to contact a switch which activates a heating element in the projection. German patent DE 20215507 discloses a heating rack having vertical tubes and horizontal tubes carrying heated water with projecting tubes for hanging articles.

In addition, numerous boot-drying devices are presented online, for example, the "Cyclone" boot dryer disclosed at www.cyclonedryers.com and several portable boot dryers at http://cozywinters.com/boot-dryers.html, among others.

However, these and other devices and methods lack the convenience, appearance, and utility of aspects of the present invention.

SUMMARY OF THE INVENTION

The present invention, in its many embodiments and aspects, was inspired by an existing coat rack. Specifically, the "Piano Coat Rack" designed and offered by Patrick Seha, a Belgian furniture designer. Though somewhat similar in appearance to the Seha coat rack, the present invention includes a wall-mounted rack/panel for drying apparel, such as, footwear and gloves. The panel includes retractable hooks or pegs upon which apparel can be hung. The pegs are hollow and perforated and fed by drying air, for example, heated drying air. The retractable pegs pivotally mount to the panel and engage an air distribution system, and, when extended, the pegs may engage the source of drying air. When not in use, the retractable pegs are retracted into the panel to, for example, provide an aesthetically appealing wall decoration.

One embodiment of the invention is an apparel drying assembly comprising or including: a panel; a projection, or a "peg," mounted to the panel, the projection having an inlet, at least one outlet, an internal passage communicating the inlet to the at least one outlet, and the projection oriented in to at least one position adapted to receive an apparel; and a source of pressurized air having an outlet in fluid communication with the inlet of the projection; wherein the pressurized air passes into the inlet of the projection, through the internal passage, and out of the at least one outlet to contact and at least partially dry the apparel received by the projection. In one aspect, the projection, or one or more projections, can be pivotally mounted to the panel. In one aspect, the pivotally mounted projection may have at least one first position extending from the panel, and a second, retracted position. When the projection is positioned in the second, retracted position, a surface of the projection can be substantially coplanar with a surface of the panel.

In another aspect, the drying assembly may further include one or more projection modules mounted to the panel, where one or more of the projection modules contain the projections. In one aspect, the projection module comprises a plurality of passages, for example, the passages having an inlet in fluid communication with the outlet of the source of pressurized air.

In one aspect, the drying assembly may also include a heater adapted to heat the pressurized air.

In one aspect, the pivotally mounted projection may further include an extension or pine from a proximal end of the pivotally mounted projection, the extension or pin positioned to deflect a valve element when the pivotally mounted projection is rotated into the at least one position adapted to receive the apparel. The extension from the proximal end of the pivotally mounted projection may be an extension of the pivotally mounted projection, a projection, a tab, a pin, a rod, or a bar. The valve element may be a deflectable baffle or a reed valve mounted to the panel.

In one aspect, when the deflectable baffle is not deflected, the baffle at least partially obstructs an opening in the panel between the source of pressurized air and the pivotally mounted projection, and wherein, when the deflectable baffle is deflected by the extension, at least some pressurized air is allowed to pass to the internal passage of the pivotally mounted projection.

Another embodiment of the invention is a method of drying apparel. The method of drying apparel comprises or includes: pivotally mounting a projection to a panel, the projection having an inlet, at least one outlet, and an internal passage communicating the inlet to the at least one outlet; providing a source of pressurized air having an outlet operatively connected to the inlet; mounting an apparel on to the projection; passing the pressurized air to the inlet of the projection, through the internal passage, and out of the at least one outlet; and contacting the air discharged from the at least one outlet upon the apparel to at least partially dry the apparel.

In one aspect, the step of mounting a projection module to the panel, wherein the projection is pivotally mounted to the projection module, may comprise the practice of pivotally mounting the projection to the panel.

In another aspect, the method may further include rotating the pivotally mounted projection from a retracted position to an extended position. In another aspect, the method may include heating the pressurized air.

In one aspect, the apparel may be footwear or hand wear.

In a further aspect, deflecting a valve element to allow the pressurized air to flow to the inlet of the projection may practice the step of passing the pressurized air to the inlet of the projection. For example, deflecting the valve element may be practiced by engaging the valve element with an extension or pin on a proximal end of the projection while pivoting the projection.

In one aspect, the valve element may a deflectable baffle or reed valve at least partially obstructing an opening in the panel between the outlet of the source of pressurized air and the inlet of the projection, and wherein engaging the valve element with the extension on the proximal end of the projection comprises contacting and deflecting the deflectable baffle to at least partially reduce obstructing the opening.

A further embodiment of the invention is an apparel drying projection module comprising or including: a housing; and a projection mounted to the housing, the projection having an inlet, at least one outlet, an internal passage communicating the inlet to the at least one outlet, and the projection oriented in to at least one position adapted to receive an apparel. In one aspect, the housing may include a pair of side elements and an internal element positioned between the side elements. In another aspect, the housing may include passages in fluid communication with the inlet of the projection and in fluid communication with a source of pressurized air. In one aspect, the module may be substantially completely made of wood, for example, a decorative hardwood.

In one aspect, the projection further comprises an extension from a proximal end of the projection, the extension positioned to deflect a valve element when the projection is rotated into the at least one position adapted to receive the apparel. The extension from the proximal end of the projection may be an extension of the projection, a projection, a tab, a pin, a rod, or a bar.

A still further embodiment of the invention an apparel drying assembly comprising or including a vertically oriented panel having an internal passage; a plurality of projections, each of the plurality of projections pivotally mounted to the vertically oriented panel, and having an inlet in fluid communication with the internal passage of the panel, at least one outlet, an internal passage communicating the inlet to the at least one outlet, and positionable in to at least one position adapted to receive an apparel; a source of pressurized air having an outlet in fluid communication with the internal passage of the panel; a valve element in the vertically oriented panel, the valve element positioned adjacent the inlet of at least one of the plurality of projections, and the valve element at least partially obstructing flow of pressurized air to the inlet of the at least one of the plurality of projections; wherein the at least one of the plurality of objections further comprises an extension positioned to contact and deflect the valve element when the at least one of the plurality of projections is pivotally rotated to at least partially reduce the obstructing of flow of pressurized air to the inlet of the at least one of the plurality of projections; and wherein the pressurized air from the source of pressurized air passes through the internal passage of the panel, passed the valve element, into the inlet, through the internal passage, and out the at least one outlet of the at least one of the plurality of projections to contact and at least partially dry the apparel received by the at least one of the plurality of projections.

In one aspect, the extension may an extension located at a distal end of the at least one of the plurality of projections, for example, an extension of the pivotally mounted projection, a projection, a tab, a pin, a rod, and a bar.

In one aspect, the valve element may be bar, a plate, a baffle, and a flap, for example, a reed valve.

In one aspect, the pivotally mounted projections may be pivotally mounted to the panel with a biasing element, for example, a spring.

In one aspect, the assembly may further include a retaining device configured to assist in retaining a positioning of projections, for example, a touch latch.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

FIG. 3 is a perspective view of a detail of the apparel drying assembly shown in FIG. 1, as identified by Detail 3 in FIG. 1, with the projection in an extended position.

FIG. 3A is a perspective view of the distal end of an alternative projection according an aspect of the invention.

FIG. 4 is a perspective view, similar to FIG. 3, of the detail shown in FIG. 3, with the projection in a retracted position.

FIG. 13 is an exploded perspective view of a portion of a side element and a pin of a projection assembly according to one aspect of the invention.

FIG. 14 is a plan view of the portion of the side element shown in FIG. 13.

FIG. 15 is a cross-sectional view of the portion of the side element shown in FIG. 14 as viewed along section lines 15-15 in FIG. 14.

FIG. 16 is a cross-sectional view, similar to FIG. 15, of the portion of the side element shown in FIG. 15 showing the relative movement of a mounting pin.

DETAILED DESCRIPTION OF THE INVENTION

Figure 2:
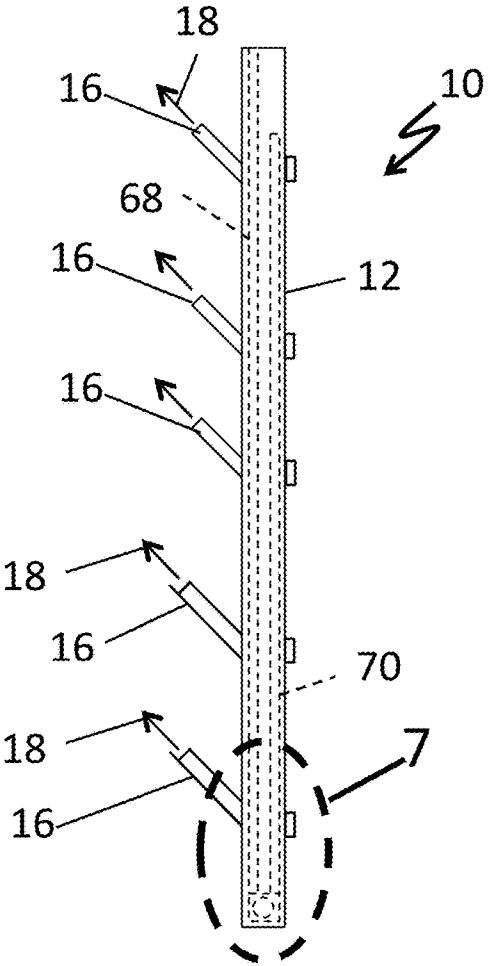
FIG. 2 is a side elevation view of the apparel drying assembly shown in FIG. 1.
Figure 1:
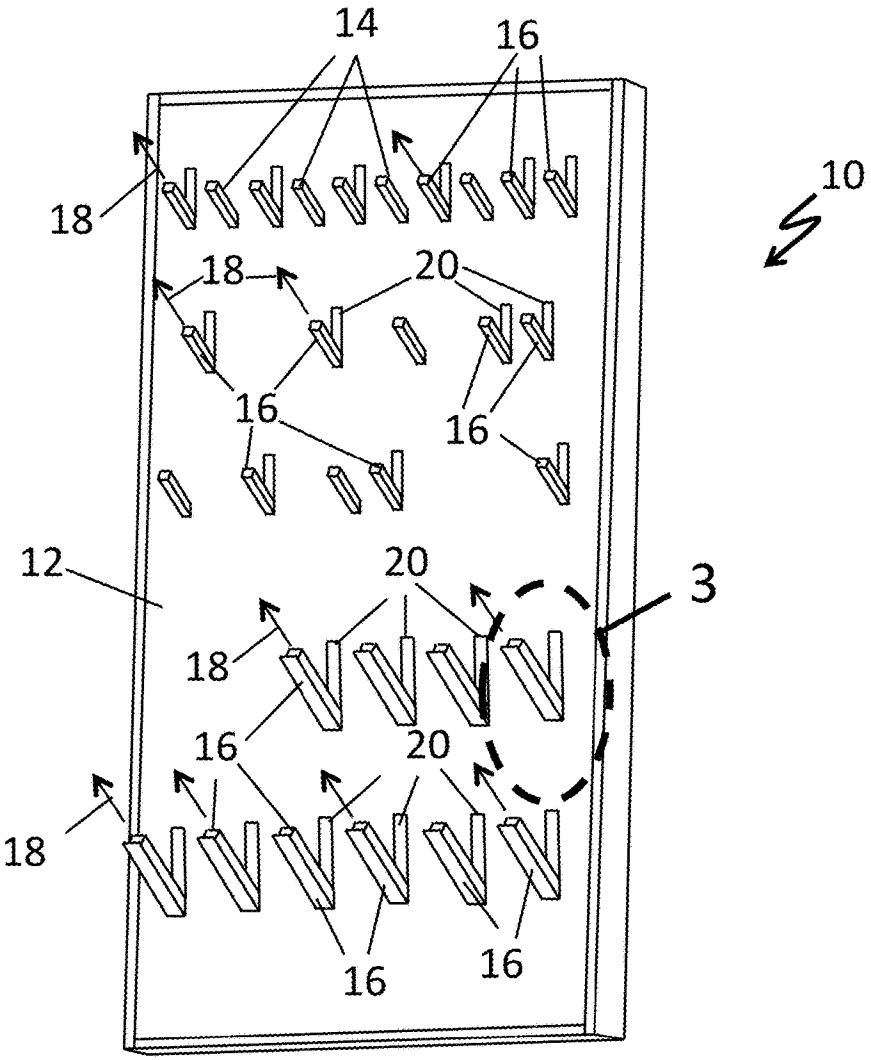
FIG. 1 is a perspective view of an apparel drying assembly according to one aspect of the invention.

FIG. 1 is a perspective view of an apparel drying assembly 10 according to one aspect of the invention. FIG. 2 is a side elevation view of the apparel drying assembly 10 shown in FIG. 1. As shown, assembly 10 typically includes a panel or board 12 having an arrangement of projections 14, or "pegs," positioned and adapted to receive an article of clothing (not shown), for example, a hat, a coat, a jacket, shoes, boots, gloves, and the like. In addition to or in lieu of projections 14, assembly 10 typically includes at least one, but typically a plurality, of projections 16 adapted to receive an article of clothing (not shown), but also adapted to discharge a flow of air 18, for example, a heated flow of air, to at least partially evaporate moisture from, for example, "to dry," an article of clothing while the article is mounted to a projection 16 of assembly 10. As also shown in FIG. 1, according to one aspect of the invention, panel 12 of assembly 10 may also include one or more cavities or recesses 20 into which projections 16 may be adapted to retract into, for example, pivotally rotate into.

FIG. 3 is a perspective view of a detail of the apparel drying assembly 10 shown in FIG. 1, as identified by Detail 3 in FIG. 1, with the projection or peg 16 in an extended position, for example, pivotally rotated out of cavity 20. FIG. 4 is a perspective view of the Detail 3 shown in FIG. 3, with the projection 16 in a retracted position, for example, pivotally rotated into cavity 20. As shown in FIGS. 3 and 4, in one aspect, projection 16 and cavity 20 may be provided as a subassembly, assembly, or projection module 22 mounted in panel 12, for example, mounted in a hole 24 in panel 12, though other methods of providing projection 16 and recess 20 in panel 12 are envisioned and will be apparent to those of skill in the art. In the aspect shown in FIGS. 3 and 4, hole 24 in panel 12 is a rectangular hole having a substantially vertical long axes, the hole 24 is sized and positioned to accept module 22, though it is envisioned that module 22 and hole 24 may assume different shapes and/or orientations.

FIG. 3A is perspective view of the distal end of an alternative projection 16A that may be used in projection module 22 shown in FIGS. 3 and 4 according an aspect of the invention. In contrast to projection 16 shown in FIG. 3, the distal end of projection 16A may be devoid of a lip or projection (see reference number 39 in FIG. 6). According to one aspect of the invention, the lip of projection 16 may be provided to uniquely adapt to accommodate an extractable drying tube (for example, as shown and described with respect to FIGS. 11 and 12).

Figure 6:
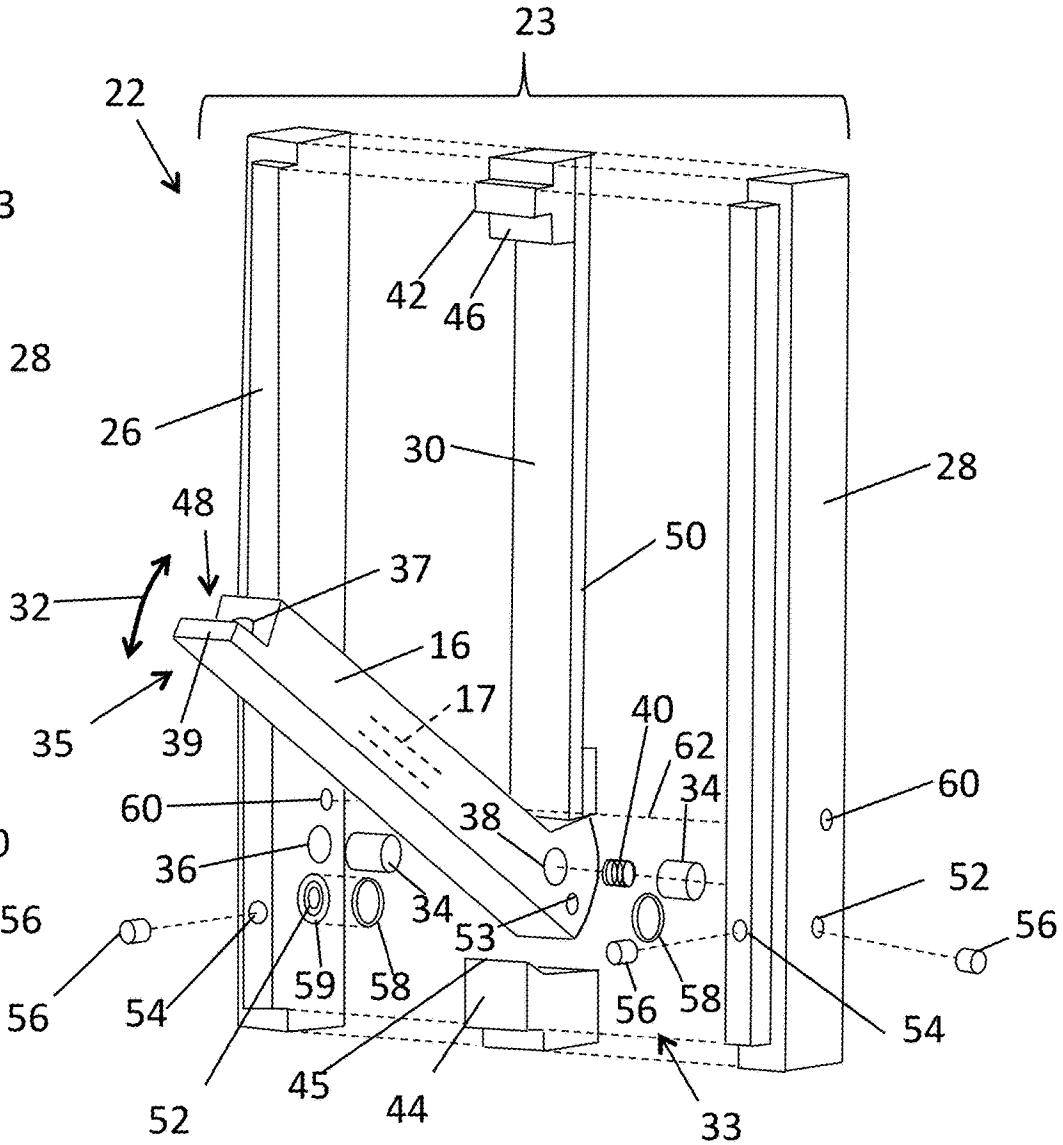
FIG. 6 is an exploded perspective view of the projection module shown in FIG. 5.
Figure 5:
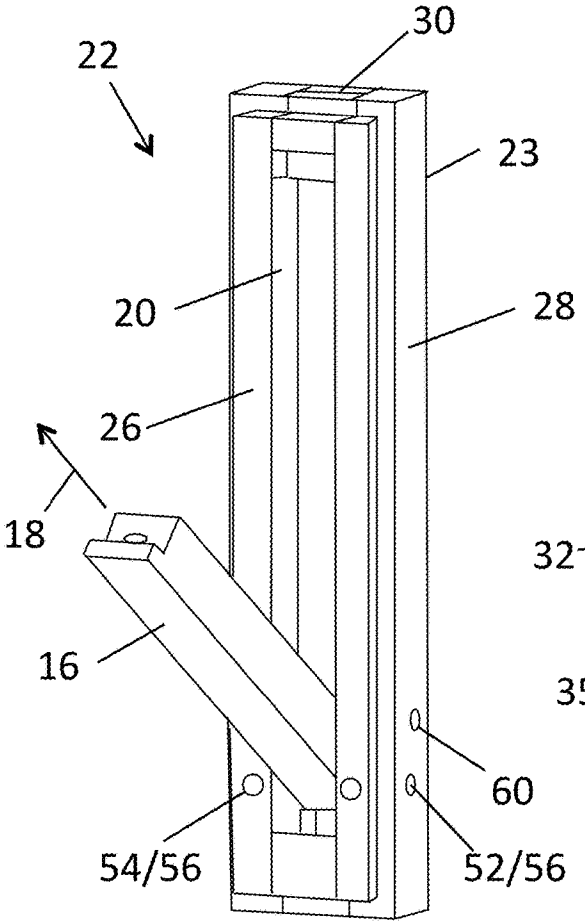
FIG. 5 is a perspective view of the projection module shown in FIG. 3.

FIG. 5 is a perspective view of the projection module 22 shown in FIGS. 3 and 4, and FIG. 6 is an exploded perspective view of the projection module 22 shown in FIG. 5. In the aspect shown in FIGS. 5 and 6, module 22 is fabricated from individual components and assembled into an integral module. The components of module 22 may be fabricated from any convenient material, for example, from a metal, from a plastic, or from wood. In one aspect, as shown in FIGS. 5 and 6, and described herein for the sake of illustration, the components of module 22 are described and illustrated as being predominantly fabricated from wood, for example, a decorative hardwood.

As most clearly shown in FIGS. 5 and 6, module 22 includes a housing 23 containing the projection 16. Housing 23 may comprise or include a pair of opposing side elements 26 and 28 which "sandwich," for example, are positioned about, an internal element 30. As shown in FIG. 6, in one aspect, projection 16 is also "sandwiched," between elements 26 and 28, and may be pivotally mounted to elements 26, 28, or both, as indicated by doubled-headed curved arrow 32. For example, in one aspect, projection 16 may be pivotally mounted at a proximal end 33 and have a distal end 35 having a hole 37 positioned and adapted to emit a flow of gas, such as forced or pressurized air. In one aspect, distal end 35 may include a lip or projection 39 adapted to engage internal element 30 when retracted and/or to conceal an extractable tube (see FIGS. 11 and 12).

In one aspect, the proximal end 33 of projection 16 may be pivotally mounted to module 22, for example, to one or both of elements 26 and 28, via one or more pins, pegs, or dowel pins 34. One or more pins 34 may be mounted in elements 26 and 28, for example, positioned in blind holes 36 (only one of which is shown in FIG. 6) in elements 26 and 28 and pins 34 may be inserted into and rotate with respect to blind or through hole 38 in projection 16. In another aspect, one or more pins 34 may be mounted in projection 16, for example, positioned in blind or through holes 38 (only one of which is shown in FIG. 6) and pins 34 may be inserted into and rotate with respect to blind or through hole 36 in elements 26 and 28. Other methods of pivotally mounting projection 16 to elements 26 and 28 are also within the purview of the present invention and will be apparent to those of skill in the art.

In one aspect, the pivotal mounting of projection 16 in module 22 may bias the position of or orientation of projection 16 in module 22. For exampled, in one aspect, the pivotal mounting of projection 16 may be biased by one or more springs or resilient materials, such as, elastomers or rubber materials. In the aspect of the invention shown in FIG. 6, the orientation of projection 16 may be biased by one or more coil springs 40, for example, inserted into hole 38 and appropriately adapted to engage and bias the position of projection 16. For instance, spring 40 may include extensions from the coil of the spring, for example, radially directed extensions that engage one or more recesses in hole 38 and/or in projection 16. In another aspect, one or more springs or elastomeric materials may bias the axial position of pins 34, for example, a coil spring 40 may bias pins 34 into axial engagement with holes 36 in elements 26 and 28. This biased axial engagement may provide for the manual engagement or disengagement of projection 16 from elements 26 and 28, for example, as "pushable" pins, for instance, for facilitating assembly, disassembly, maintenance, and/or repair of module 22.

In one aspect, module 22 may include one or more "stops" or restrictions that limit the rotation of projection 16. For example, as shown in FIGS. 5 and 6, internal element 30 of module 22 may include an upper stop 42 and a lower stop 44 positioned and sized to limit or impede the travel of projection 16. Upper stop 42 and lower stop 44 may be integrally mounted to internal element 30, or comprise distinct, separate components. Upper stop 42 may provide a surface 46 positioned to contact and limit the travel of projection 16, for example, surface 46 may be shaped and positioned to contact a surface of projection 16, for example, the face 48 of lip 39. In a preferred, but non-limiting, aspect, upper stop 42 and the distal end 35 of projection 16 may be sized and shaped wherein, when retracted (see FIG. 4), the external surface of projection 16 is substantially co-planar with the surfaces of elements 26 and 28 and/or the surface of panel 12 (see FIGS. 3 and 4), for instance, the surfaces of projection 16 and elements 26 and 28 may be substantially "flush" with each other.

Lower stop 44 may provide a surface 45 positioned to contact and limit the travel of projection 16, for example, surface 45 mat be shaped and positioned to contact a surface of projection 16. In a preferred, but non-limiting, aspect, lower stop 44 and the proximal end 33 of projection 16 may be sized and shaped wherein, when retracted (see FIG. 4), the external surface of projection 16 is substantially co-planar with the surfaces of elements 26 and 28 and/or panel 12, for instance, the surfaces of projection 16 and elements 26 and 28 are substantially "flush" with each other.

Upper stop 42 and/or lower stop 44 may be mounted on a common spine 50 of internal element 30 which may extend between upper stop 42 and lower stop 44.

According to aspects of the invention, projection module 22 may typically include a network of passages adapted to transmit air, for example, from a source of pressurized air, to projection 16 to be emitted to an article of apparel as indicted by arrow 18 in FIG. 5. As shown in FIG. 6, projection 16 may have one or more openings or orifices 37, for example, at the distal end 35, which is in fluid communication with one or more internal passages 17 in projection 16. Though in one aspect of the invention a single opening 37 and a single internal passage 17 may be provided in projection 16, it is envisioned that 2 or more openings 37 in fluid commination with one or more internal passages 17 may be provided. The two or more openings 37 may be directed axially and/or transversely (for example, radially) from projection 16. According to aspects of the invention, the internal passage 17 of projection 16 may be in fluid communication with fluid passages in any one or more of side elements 26 and/or 28, and/or internal element 30. Internal passage 17 may have any desired cross-section, though in one aspect a circular passage is preferred. The internal diameter of a circular internal passage 17 may range from about 0.125 inches to about 2 inches, depending, among other things, upon the size of projection 16. However, typically, internal passage 17 may have a diameter ranging from about 0.25 inches to about 0.75 inches, for example, about 0.5 inches.

Though many different sized and located passages may be provided inside elements 26 and 28 and internal element 30, in the aspect of the invention shown in FIGS. 5 and 6, side elements 26 and 28 may have passages defined by holes 52 and 54, for example, through holes or blind holes. Holes 52 and 54 may typically be plugged as needed by inserting plugs 56, for example, a press fit and/or with an adhesive. According to one aspect, holes 52 and 54 in side elements 26 and 28 may communicate with one or more holes 53 in the proximal end 33 of projection 16. The one or more holes 53 in projection 16 may communicate with internal passage 17 to supply an airflow to one or more openings 37. In one aspect, in order to minimize or prevent air leakage between adjacent air passages, some form of sealing elements or devices may be provided in or about holes 52 and/or 53 and/or 54. In one aspect, as shown in FIG. 6, one or more O-rings 58 may be provided as needed, for example, inserted into O-ring seats 59 (only one of which is shown in FIG. 6) in side elements 26 and/or 28. Other sealing means may also be used, and, in one aspect, no sealing means may be provided. Holes 52, 53, and 54 may have diameters ranging from about 0.125 inches to about 1 inch, depending, among other things, upon the size of elements 26 and 28 and projection 16. However, typically, holes 52, 53, and 54 may have a diameter ranging from about 0.125 inches to about 0.5 inches, for example, about 0.375 inches.

In one aspect of the invention, projection module 22 may include one or more means to automatedly detecting the positioning of projection 16 to, for example, initiate the flow of drying air through module 22 (as discussed with respect to FIGS. 7 and 8, below). For example, in one aspect, one or more sensors may be provided in or about assembly 22 to detect the positioning of projection 16. In one aspect, the positioning of projection 16 may be detected photometrically, for example, by means of the detection of the presence or absence of light upon a photo detector. In one aspect, as shown in FIGS. 5 and 6, through holes 60 may be provided in side elements 26 and/or 28 through which a light beam, for example, laser beam, may be passed (as indicated by dashed line 62 in FIG. 6). In one aspect, when projection 16 is deflected into the extended position, as shown in FIGS. 5 and 6, an unobstructed path for light beam 62 is provided between holes 60. This light beam 62 may then be detected by a photodetector (not shown), for example, a photodetector positioned in module 22, in an adjacent module 22, or as appropriate anywhere in apparel drying assembly 10. The photodetector may be adapted to emit an electrical signal when light or lack of light is detected, for example, emit an electrical signal via a controller, to initiate activation of the source of drying air flow, for example, to a fan assembly. Conversely, when projection 16 is retracted, as shown in FIG. 4, the path of light beam 62 may be interrupted and the operation of the source of airflow may be terminated or "shut off." Other means of initiating and terminating air flow with sensors, detectors, and/or linkages are also within the purview of the present invention.

Side elements 26 and 28 and internal element 30 may be assembled by any conventional means, for example, with mechanical fasteners, adhesives, and/or welding or brazing, for instance, when manufactured from metallic components.

Figure 7:
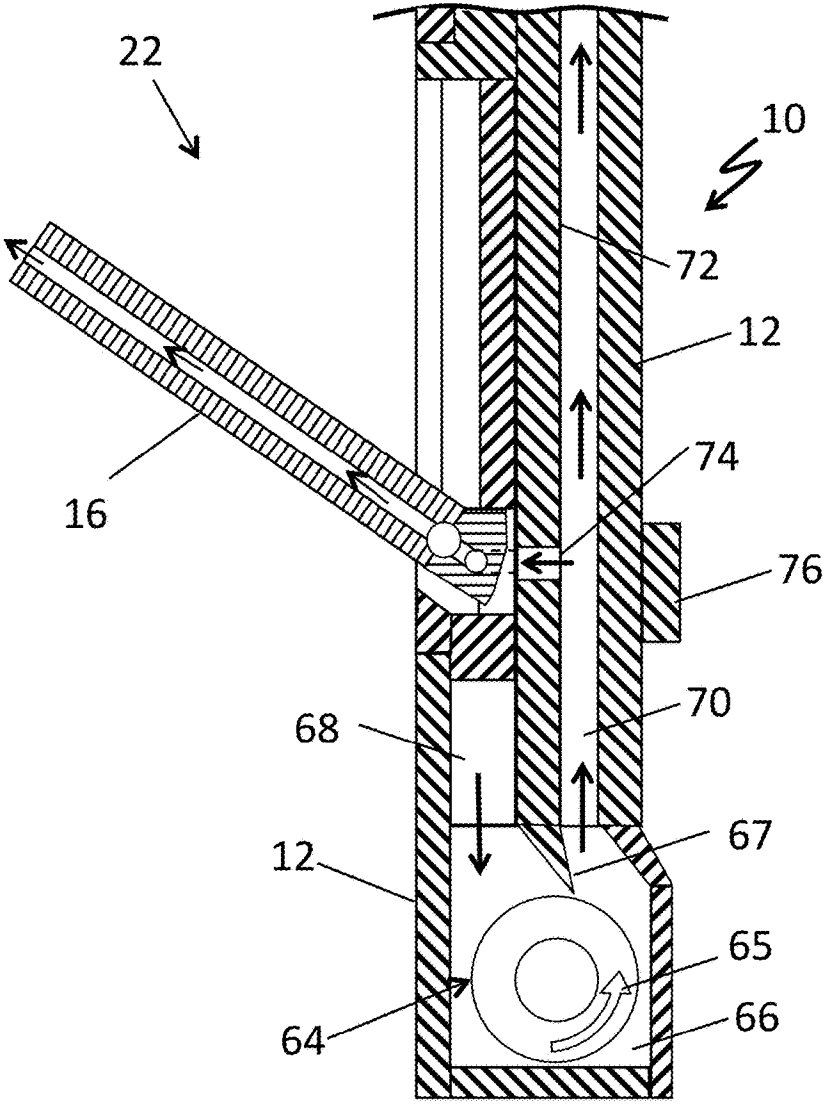
FIG. 7 is a cross sectional view of the apparel drying assembly shown in FIG. 2 as identified by Detail 7 shown in FIG. 2, with the projection in an extended position.

FIG. 7 is a detailed cross sectional view of apparel drying assembly 10 shown in FIGS. 1 and 2 as indicated by Detail 7 in FIG. 2, with projection 16 shown in an extended position. FIG. 8 is a detailed cross sectional view similar to FIG. 7, with projection 16 shown in a retracted position. In addition to illustrating panel 12 and projection module 22 with projection 16, FIGS. 7 and 8 also schematically illustrate the location in assembly 10 of fan assembly 64 according to one aspect of the invention. Though fan assembly 64 may be located anywhere convenient in assembly 10, in one aspect, for example, fan assembly 64 may be located in the bottom of panel 12 and direct a flow of air upward into panel 12, though other locations and directions of airflow for fan assembly 64 may be provided according to aspects of the invention. The rotation of fan assembly 64 is represented by arrow 65 in FIG. 7. In another aspect, fan assembly 64 may not be located within panel 12, but may be located adjacent to or remote from panel 12 and communicate with panel assembly 12 via one or more conduits or passageways as indicated by conduit 13 and/or 15 shown in FIG. 8 in phantom.

Fan assembly 64 may be any conventional fan assembly having the size and airflow output required to provide the desired drying function. Fan assembly 64 may typically have an airflow output of at least about 5 cubic feet per minute [$ft^3$/min] and at most about 400 $ft^3$/min, but typically ranges from about 10 $ft^3$/min to about 100 $ft^3$/min. In one aspect, fan assembly 64 may be a BK Squirrel Cage Blower Fan assembly provided by Smoky Mountain General Store [available at http://www.smgeneralstore.com/bk-blower-fan-bk.aspx], or its equivalent, though any appropriate conventional fan assembly may be used. Since fan assembly 64 is shown schematically in FIGS. 7 and 8, ancillary equipment typically provided with a fan assembly 64, such as, a power supply, a drive motor, electronic controls, anti-friction bearings, and mounting structures and hardware, are not illustrated in FIGS. 7 and 8, but are envisioned, as needed.

According to aspects of the invention, apparel-drying assembly 10 typically includes some form of cavity 66 sized, positioned, and appropriately sealed to retain fan assembly 64. As shown in FIG. 7, in one aspect, cavity 66 may be in fluid communication with one or more passages 68 within panel 12 adapted to communicate air, for example, ambient air, to cavity 66 and fan assembly 64. In one aspect, as shown in FIG. 1, one or more passages 68 may extend to the upper portion or top of panel 12, for instance, to draw warmer air from the top of a room having drying assembly 10 mounted therein. Also, cavity 66 may be in fluid communication with one or more passages 70 within panel 12 adapted to communicate pressurized air from fan assembly 64 to one or more projection modules 22, and ultimately to one or more projections 16. As also shown in FIGS. 7 and 8, cavity 66 may include one or more baffles 67 positioned to assist in promoting airflow from cavity 66 to passage 70. As shown in FIGS. 7 and 8, panel 12 may typically include at least one distribution plate or panel 72 having at least one perforation or hole 74, but typically, a plurality of perforations or holes 74, adapted to direct air from passage 70 to one or more projection modules 22. In one aspect, the interface between panel 72 and module 22 at or around holes 74 may be provided with a sealing device, for example, one or more O-rings (not shown) mounted in an O-ring seat.

Aspects of the invention may also provide one or more devices for heating and/or dehumidifying the airflow introduced to projections 16. For example, in one aspect, an internal or external heater or heat exchanger may be provided in panel 12 and/or adjacent to or remote from panel 12, for example, associated with conduit 13 or conduit 15. For instance, in one aspect, cavity 66 in panel 12 may be sized to contain fan assembly 64 and a heater (not shown). The heater may be a radiant heater (for example, an electric radiant heater or a hot water radiant heater), a hydronic heater, or an oil-, gas-, wood-, or pellet-fired heater. In one aspect, panel 12 may be in fluid communication with an existing heat source, for example, a residential forced-air furnace or a stove, such as, a wood stove, a pellet-burning stove, a propane heater, or a natural gas heater, among others. The one or more heat sources disclosed herein may be used to heat the air flow where the temperature of the air flowing from fan assembly 64 is at least 5 degrees F. above ambient air temperature, in one aspect, at least 10 degrees F. above ambient air temperature. For example, in one aspect, the temperature of the air emitted by projections 16 may range from about 50 degrees F. to about 150 degrees F., but is typically between about 90 degrees F. and about 120 degrees F.

Panel 12 may include a plurality of mounting bars or mounting elements 76 appropriately positioned and configured to mount assembly 10 to a surface, for example, to a vertical wall.

According to aspects of the invention, with the activation of fan assembly 64, for example, via the detection of the deflection of projection 16 via a photodetector discussed herein, fan assembled 64 rotates in the direction of arrow 65 and provides a flow of air to one or more passages 70. Under the operation of fan assembly 64, air is drawn into cavity 66 from one or more intake passages 68, for example, drawn from one or more inlets in the top or upper portion of assembly 10. The pressurized air in passage 70 may typically range from about 0.01 to about 10 pounds per square inch—gauge (psig), but is typically between about 1 inch of water gauge [iwg] (that is, about 0.04 psig) and about 10 iwg (that is, about 0.40 psig). The flow of air within one or more passages 70 distributes pressurized air to one or more holes 74 in distribution panel 72 and to the one or more projection modules 22 and to projections 16. The flow of air into holes 74 may be enhanced by positioning one or more baffles 75 (shown in phantom in FIG. 8) shaped and positioned to direct or encourage airflow into holes 74.

Figure 8:
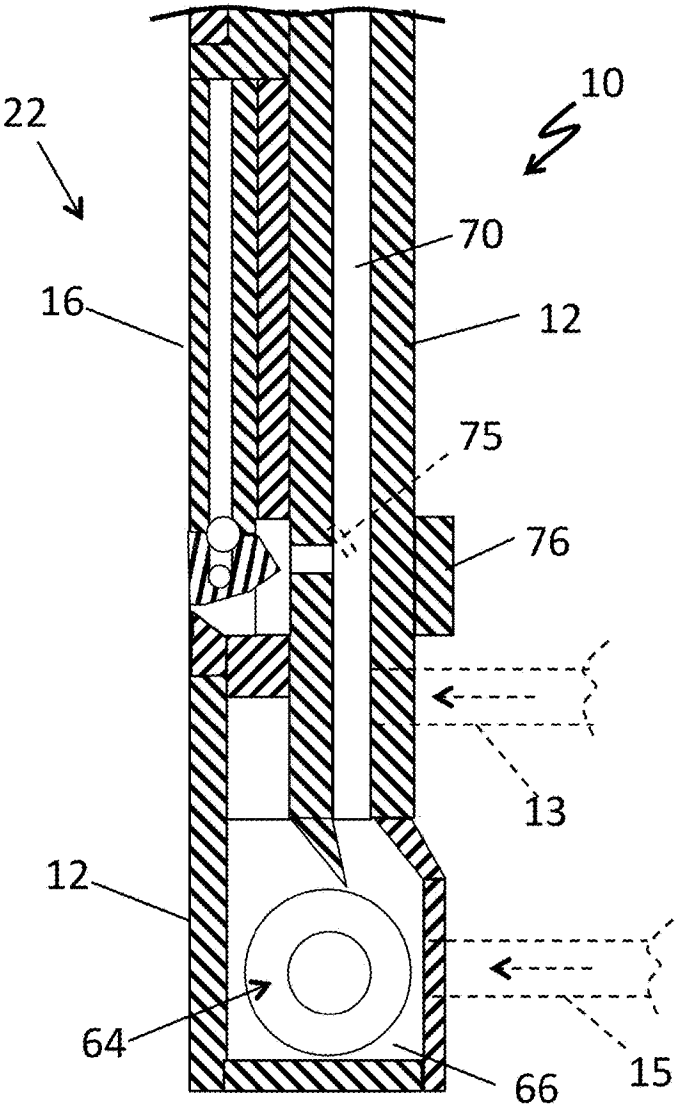
FIG. 8 is a cross sectional view, similar to FIG. 7, of the detail shown in FIG. 7, with the projection in a retracted position.

As shown in FIG. 8, when fan assembly 64 is not operating, projection 16 of projection module 22 may be retracted. When retracted, as shown in FIG. 8, projection 16 may be retained in the retracted position by conventional means, for example, with mechanical fasteners or biasing springs. In one aspect, projection 16 may be retained in the retracted position by friction, for example, friction between opposing surfaces and/or friction between a sealing device, such as, an O-ring, and an opposing surface. However, in one aspect, no mechanical device may be required to retain projection 16 in its retracted position shown in FIG. 8. In addition, when retracted, the position of projection 16 may be detected by one or more sensors, as disclosed herein, where fan assembly 64 is deactivated.

Figure 9:
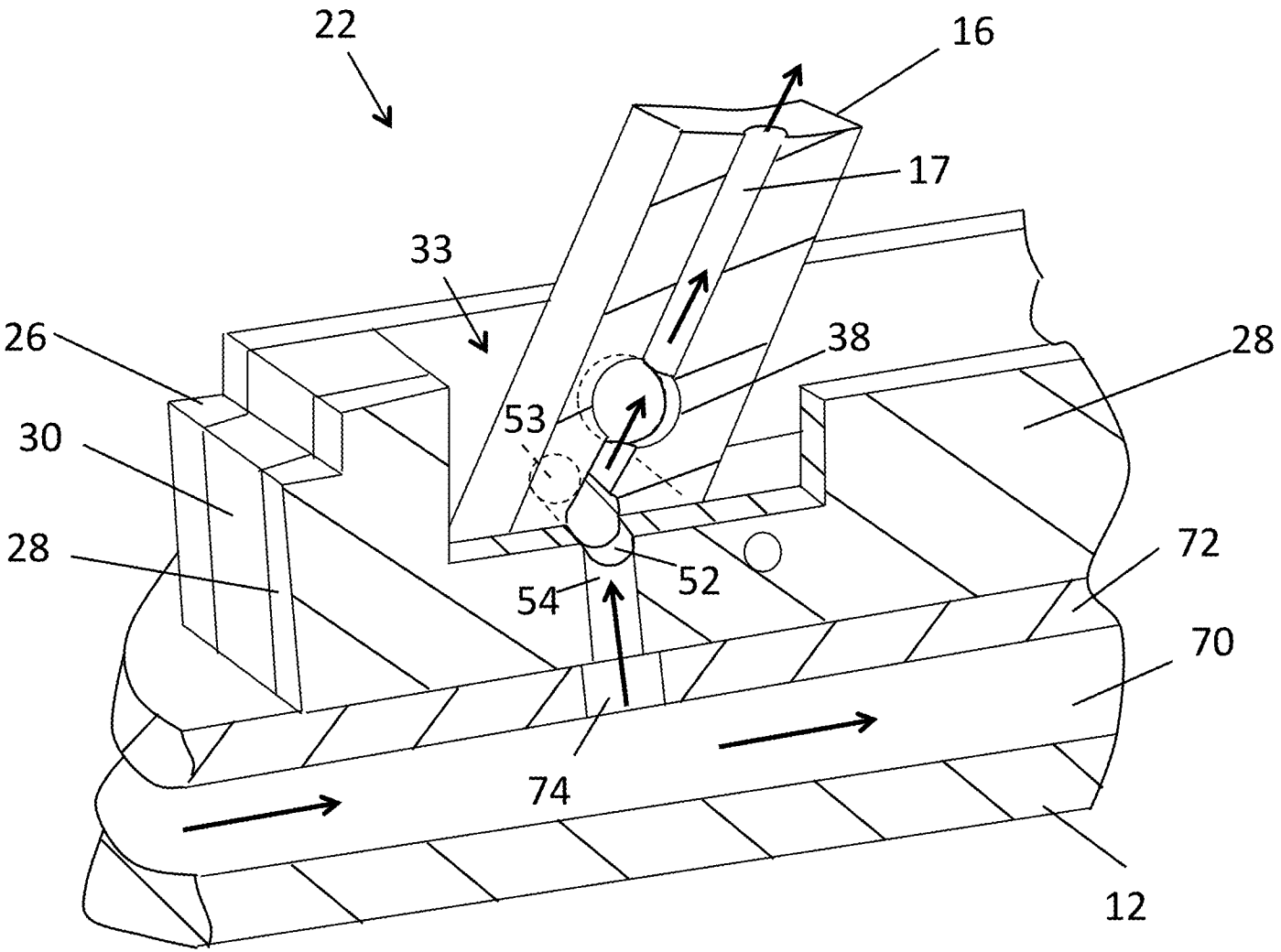
FIG. 9 is a perspective view, partially in cross section, of one set of air passages in the apparel drying assembly shown in FIGS. 1 and 2 according to one aspect of the invention.

FIG. 9 is a perspective view, partially in cross section, of one set of passages in apparel drying assembly 10 shown in FIGS. 1 and 2 according to one aspect of the invention. FIG. 9 includes portions of projection module 22, including projection 16, side elements 26 and 28, and internal element 30; a portion of panel 12; a portion of distribution panel 72 having at least one hole 74; and a portion of passage 70, as disclosed herein. As shown in FIG. 9, in one aspect, pressurized air introduced to passage 70 passes through one or more holes 74 in distribution panel 70 and is introduced to projection module 22, for example, to one of the through holes 54 of side element 28. As shown in FIG. 9, in one aspect, through holes 54 communicate with one or more holes 53 in the distal end 33 of projection 16. In the proximal end 33 of projection 16, holes 53 communicate with internal passage 17 of projection 16. Internal passage 17 may pass through hole 38 that contains pin 34 and, for example, coil spring 40 (not shown in FIG. 9). For example, in one aspect, pressurized air may flow passed pins 34 and through spring 40 en route through internal passage 70. According to aspects to the invention, internal passage 17 distributes the airflow to one or more holes or orifices in projection 16, for example, to one or more holes 37 at the distal end 35 of projection 16 (see FIGS. 5 and 6).

Figure 10:
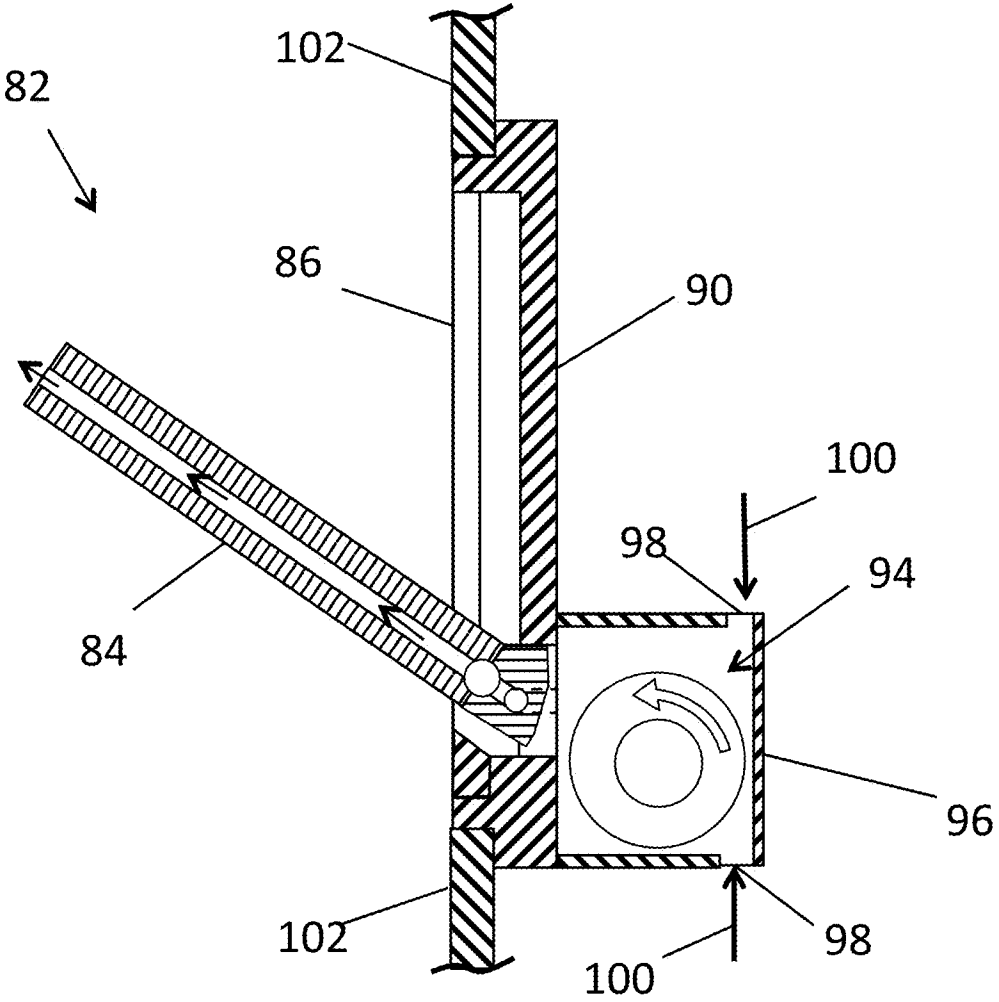
FIG. 10 is a cross sectional view, similar to FIGS. 7 and 8, of a projection module with a projection in an extended position according to another aspect of the invention.

FIG. 10 is a cross sectional view of a projection module 82 having a pivotally mounted projection 84 in an extended position according to another aspect of the invention. In a manner, similar to projection module 22 disclosed herein, projection module 82 may typically include side elements 86 and 88 (not shown) and internal element 90. Otherwise module 82 may include all the features and functions of module 22. In the aspect of the invention shown in FIG. 10, projection module 82 may also include a source of pressurized air 94, for example, an electric fan, contained in a housing 96 mounted to, for example, side elements 86 and 88 and internal element 90. According to the aspect of the invention shown in FIG. 10, projection module 82 includes a dedicated source of pressurized air 94. Though in FIG. 10 source 94 comprises a squirrel-cage type fan or blower, any source of pressurized air may be used with aspects of the invention. Module 82 may also include a heat source adapted to heat the air propelled by the source of pressurized air 94.

As shown in FIG. 10, housing 96 for fan 94 may typically include one or more inlets or apertures 98 allowing air, for example, ambient air, to be drawn into housing 96, as indicated by arrows 100. The air drawn in by fan 96 is then expelled by fan 94 from housing 96 into projection 84, for example, as disclosed herein, to dry the piece of apparel (not shown) mounted on projection 84.

According to this aspect of the invention, module 82 having fan 94 may comprise a self-contained device for drying apparel. For example, as illustrated in FIG. 10, projection module 82 may be positioned or mounted in to a wall, surface, or a panel 102 and the pivotally mounted projection 84 may provide the drying function disclosed herein. Projection module 82 may be mounted to wall, surface, or panel 102 by conventional means, for example, with mechanical fasteners or an adhesive. For example, in one aspect, a plurality of modules 82 may be mounted into a wall, surface, or panel, such as, into panel 12 shown in FIG. 1. In one aspect, two modules 84 may be mounted in a closet or locker to dry footwear, such as, work boots, skates, sneakers, cleats, and the like; or hand wear, such as, gloves, mittens, and the like, as disclosed herein.

Figures 11, 12:
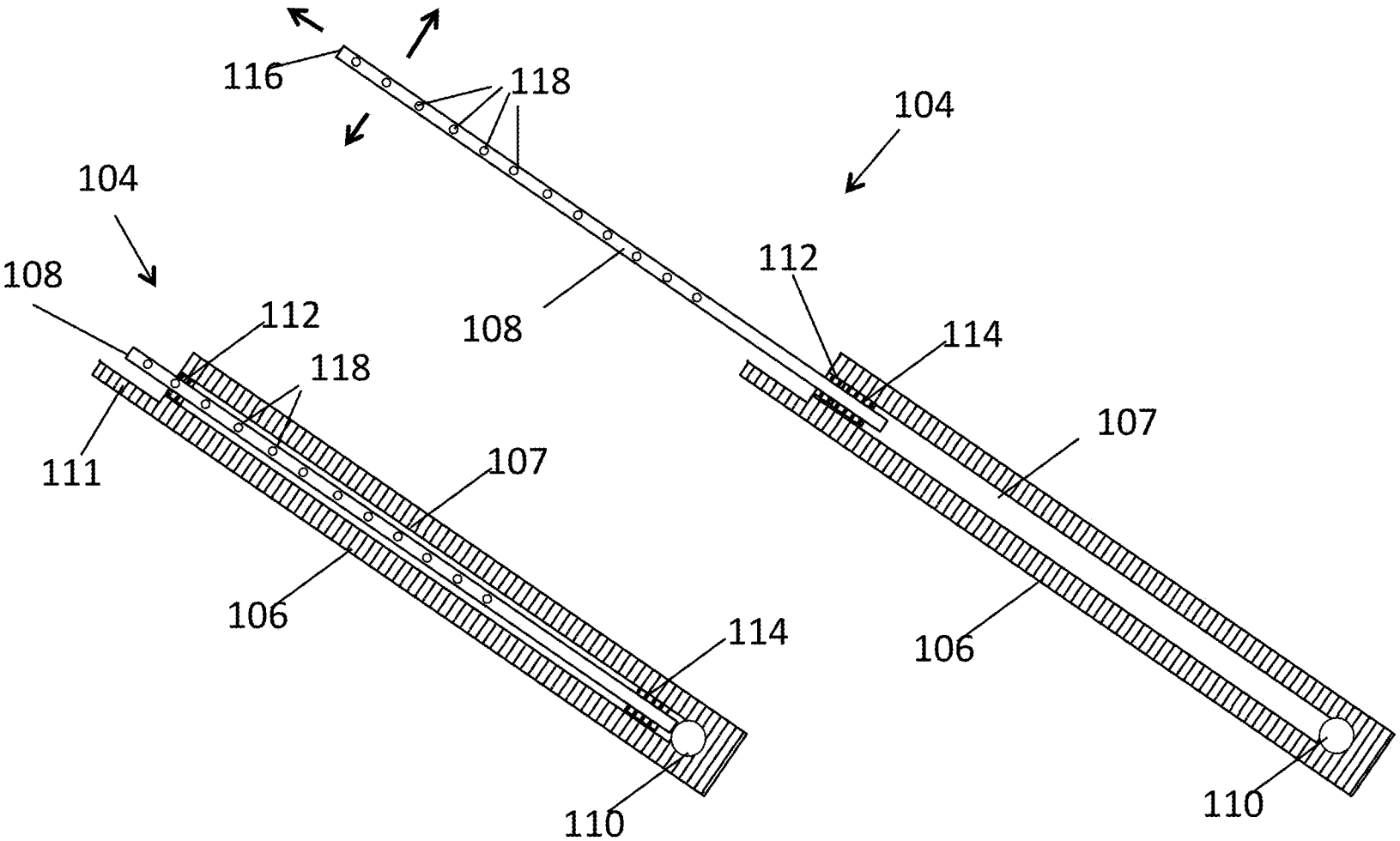
FIG. 11 is a cross sectional view of a projection having an extractable air distribution tube in a retracted position according to another aspect of the invention.
FIG. 12 is a cross-sectional view, similar to FIG. 11, of the projection shown in FIG. 11 having the extractable air distribution tube in an extracted position according to another aspect of the invention.

FIG. 11 is a cross-sectional view of a projection assembly 104 having a projection 106 and an extractable air distribution tube or hose 108 in a retracted position according to another aspect of the invention. As shown, in this aspect, projection 106 includes an internal passage 107 into which tube 108 can be slidably placed. In a manner similar to projection 16 disclosed herein, projection 106 may typically be pivotally mounted, and internal passage 107 is typically in fluid communication with a source of pressurized air, for example, via one or more holes 110 in the proximal end of projection 106. According to the aspect of the invention shown in FIG. 11, tube 108 is also in fluid communication with the source of pressurized air, and, when extracted (as shown in FIG. 8), tube 108 can be inserted into the apparel mounted on projection 106 to enhance the distribution of drying air into the apparel, for example, into the toe of a shoe, boot, or skate that requires drying. In the aspect shown in FIG. 10, projection 106 may include a lip or projection 111 adapted to conceal and/or protect an end of tube 108, which may protrude from internal passage 107, for example, to conceal tube 108 when projection 106 is in the pivotally retracted position. In other aspects, the lip 111 may be omitted.

In one aspect, projection 106 may be adapted to retain tube 108 in internal passage 107. For example, in one aspect, projection 106 may include an obstruction or restriction 112 adapted to engage and/or retain tube 108 in projection 106. In one aspect, tube 108 may include an annular projection or ring 114 positioned and sized to translate with tube 108 along internal passage 107 and contact obstruction 112 to prevent complete removal of tube 108 from projection 106. Other means of retaining tube 108 within projection 106 will be apparent to those of skill in the art.

FIG. 12 is a cross-sectional view, similar to FIG. 11, of the projection assembly 104 shown in FIG. 11 having the extractable air distribution tube 108 in an extracted position according to another aspect of the invention. As shown in FIG. 12, with the partial extraction of tube 108, ring 114 may contact restriction 112 and limit or prevent the total extraction of tube 108, for example, to prevent removal.

Tube 108 may comprise a hollow conduit, for example, a hollow flexible conduit, having at least one axial hole 116 at its end, and may have a plurality of radially directed holes 118 adapted to direct air radially from tube 108. Tube 108 may be made from a plastic or elastomeric material. In one aspect, tube 108 may have an outside diameter ranging from about 0.0625 inches to about 0.50 inches, but typically has an outside diameter ranging from about 0.125 to about 0.25 inches. Tube 108 may have an inside diameter ranging from about 0.0325 to about 0.375 inches, but typically has an inside diameter ranging from about 0.1625 to about 0.125 inches. Radial holes 118 may be uniformly distributed along tube 108 and may have diameters ranging from about 0.0325 inches to about 0.375 inches, but typically having a diameters ranging from about 0.1625 to about 0.125 inches.

FIG. 13 is an exploded perspective view of a portion of a side element 26 of projection assembly 22 and a pin 34 shown in FIGS. 5 and 6 according to one aspect of the invention. As shown, side element 26 includes a blind hole 36 sized and positioned to receive pin 34. As illustrated in FIG. 6, pin 34 may be biased into position in blind hole 36 by, for example, coil spring 40. According to this aspect of the invention, the geometry of blind hole 36 may be adapted whereby projection 16 may be more readily pivotally mounted to side elements 26 and 28, and disengaged from side elements 26 and 28, for example, for assembly, servicing, or maintenance of projection assembly 22. According to aspects of the invention, side element 28 (not shown) may comprise a mirror image of side element 26 shown in FIG. 13 and include a blind hole 36 having substantially identical adaptations to enhance mounting and disengagement.

FIG. 14 is a plan view of the portion of the side element 26 shown in FIG. 13. As shown, in this aspect, blind hole 36 in side element 26 is adapted to engage and disengage pin 34 (not shown in FIG. 14). Accordingly, in one aspect, the blind hole 36 includes a ramp or tapered recess 120 adapted to allow engagement and/or disengagement of pin 34 with side element 26. The angle of orientation, a, of ramp 120 is chosen where the projection 16 (not shown in FIG. 14) and pin 34 can be removed or disengaged from side element 26 (for example, when projection 16 is not loaded by an apparel, such as, a boot), but where side element 26 will retain projection 16 and pin 34 when projection 16 is loaded, for example, with a boot. In one aspect, the angle of orientation a may range from about 20 degrees to about 70 degrees, but is typically between about 20 degrees and about 40 degrees, for example, about 30 degrees. The width 124 of ramp 120 may typically be about the diameter of blind hole 36, for example, the width 124 may range from about 0.25 inches to about 2 inches, but is typically between about 0.5 inches and 1 inch, for example, about 0.625 inches.

FIG. 15 is a cross sectional view of the portion of side element 26 shown in FIG. 14 as viewed along section lines 15-15 in FIG. 14. Pin 34 is shown in phantom in FIG. 15 for reference. As shown most clearly in FIG. 15, ramp 120 tapers at an angle β from the bottom or base of blind hole 36 to the surface 122 of side element 26. In one aspect, as shown in FIG. 15, ramp 120 may intersect the surface 122 at an edge of side element 26; however, in another aspect, ramp 120 may intersect surface 122 at a location interior of an edge. The angle β of ramp 120 may range from about 0.5 degrees to about 30 degrees, but is typically between about 10 degrees and 20 degrees, for example, about 17 degrees.

As shown in FIG. 15, blind hole 36 may have a depth 126 and a diameter 128. Depth 126 may range from about 0.03125 inches to about 1 inch, but is typically between about 0.0625 inches to about 0.25 inches, for example, about 0.125 inches. Diameter 128 of blind hole 36 may range from about 0.25 inches to about 2 inches, but is typically between about 0.5 inches and about 1 inch, for example, about 0.625 inches.

FIG. 16 is a cross sectional view, similar to FIG. 15, of the portion of the side element 26 shown in FIG. 15 showing the relative movement of mounting pin 34 according to one aspect. In order to aid in the disclosure of this aspect, a representative portion of projection 16, pins 34, and biasing spring 40 are also shown in phantom in FIG. 16. In one aspect, as projection 16 is disengaged from side element 26 (and from side element 28, not shown) as indicated by the direction of arrow 130, under the influence of spring 40, pin 34 engages blind hole 36 and is displaced from blind hole 36 and slidably engages ramp 120. Further movement of projection 16 in the direction of arrow 130 further displaces pin 34 along ramp 120 until pin 34 disengages ramp 120 and projection 16 with pins 34 disengages side element 26 (and side element 28). In a similar fashion, projection 16 and pins 34 can engage side element 26 (and side element 28) by reversing the movement indicated by arrow 130 until pins 34 re-engage blind hole 36.

According to aspects of the invention, the disengagement and engagement (or re-engagement) of projection 16 from side elements 26 and 28 may allow projection 16 and projection module 22 (and any projection module disclosed herein) to be serviced, maintained, or replaced. In addition, ready removal and re-engagement of projection 16 with side elements 26 and 28 can allow access to other components of the invention, for example, to distribution panel 72 (see FIG. 7), to mounting elements 76 (see FIG. 7) and fasteners associated with mounting elements 76, fan assembly 94 (see FIG. 10), spring 40, and pins 34, among other components.

Figure 18:
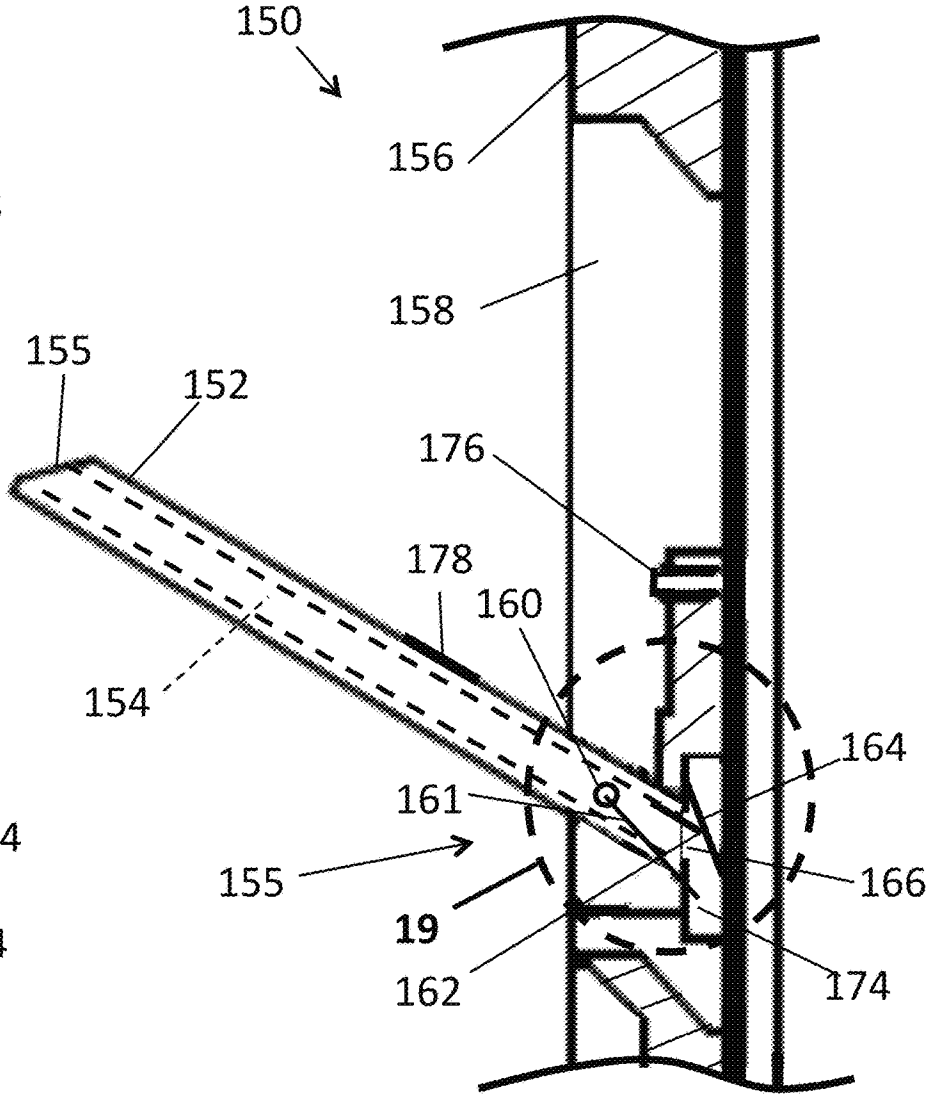
FIG. 18 is a side elevation, partially in cross section, of the apparel drying assembly shown in FIG. 17, with the projection in an extended position.
Figure 17:
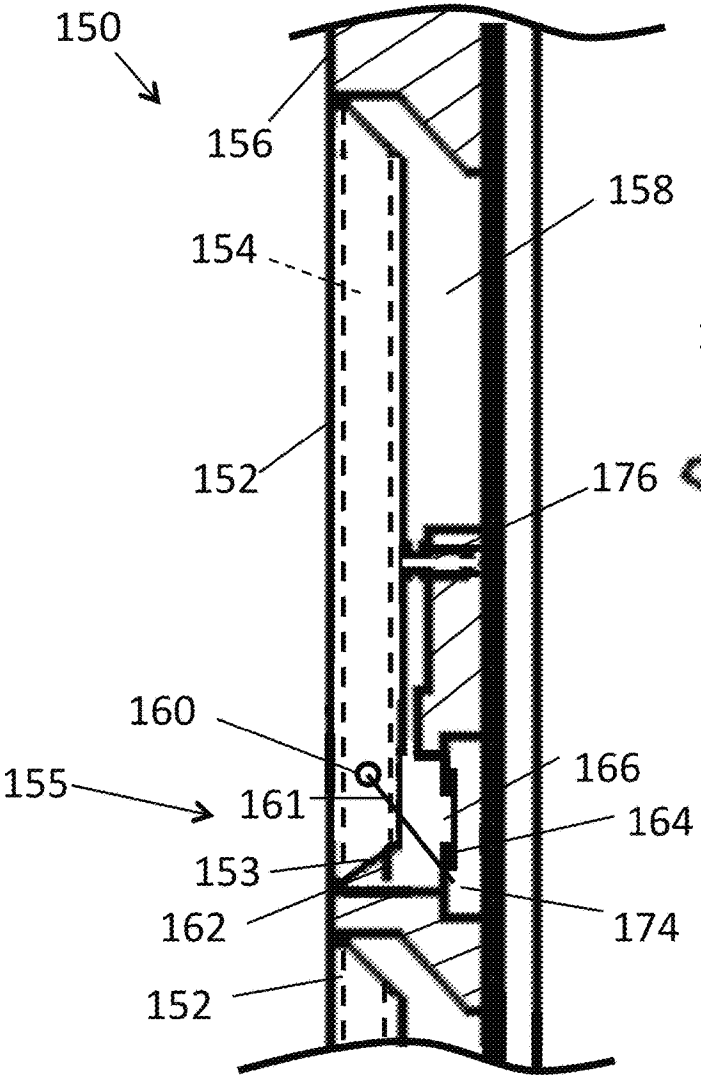
FIG. 17 is a side elevation view, partially in cross section, of an apparel drying assembly according to an aspect of the invention, with the projection in a retracted position.
Figure 29:
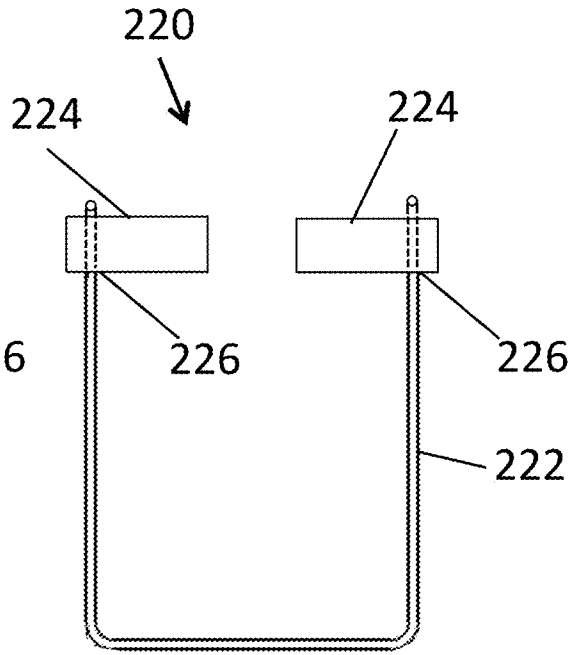
FIG. 29 is a plan view of the spring wire assembly shown in FIG. 28.
Figure 28:
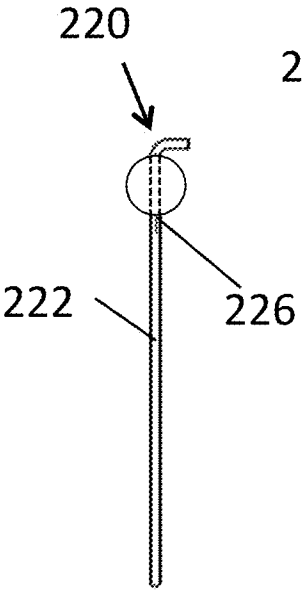
FIG. 28 is a side elevation view of a spring wire assembly, which may be used to bias the position of plate shown in FIGS. 17-19 according to one aspect of the invention.

FIG. 17 is a side elevation view, partially in cross section, of an apparel drying assembly or module 150 according to an aspect of the invention, with a projection 152 in a retracted position. FIG. 18 is a side elevation of the apparel drying assembly or module 150 shown in FIG. 17, with the projection 152 in an extended position. Similar to other aspects of the invention disclosed herein, projection or "peg" 152 includes an internal passage 154 having an open end 153. Open end 153 is operatively connected to a source of pressurized air, and projection 152 may be pivotally mounted at a proximal end 155 to a housing 156, for pivotally rotating projection 152 in to and out of a cavity or recess 158 in housing 156. According to this aspect, projection 152 may be pivotally mounted to housing 156 via a pin or dowel 160, for example, a pin 160 having a biasing spring 161 (for example, as shown in FIGS. 28 and 29). As disclosed herein, pressurized air may be passed through internal passage 154 and directed out of open end 155 to dry a piece of apparel (not shown) mounted to projection 152.

Also similar to other aspects disclosed herein, assembly 150 may be provided as a subassembly, an assembly, or a projection module 150 mounted in a wall or panel not shown, for example, into the assemblies shown in FIGS. 42-45.

In the aspect of the invention shown in FIGS. 17 and 18, pivotally mounted projection 152 includes an extension 162 from proximal end 155, and the extension 162 is positioned and adapted to deflect a valve element when the pivotally mounted projection 152 is at least partially rotated into the extend position shown in FIG. 18, for example, a position adapted to receive the apparel (not shown). In one aspect, the extension of proximal end 155 may comprise an extension of the pivotally mounted projection 152, or a projection, a tab, a pin, a rod, a bar, or a related structure mounted to the proximal end 155 of projection 152. In the aspect of the invention shown in FIGS. 17 and 18, the extension may comprise one or more bars or pins 162.

According to aspects of the invention the extension, for example, bar 162, on the proximal end 155 of projection 152 may be positioned and adapted to engage any form of valve element or valve member, for example, a flap, a seat, a stem, a ball, or a plug, where pressurized air provided to housing 156 is provided to the internal passage 154 of projection 152. In the aspect of the invention shown in FIGS. 17 and 18, housing 156 includes one or more deflectable bars, plates, baffles, flaps, or reed valves 164 positioned over a hole or orifice 166 in housing 156. A detail of the deflection of one valve element according to one aspect of the invention is shown in FIG. 19.

In one aspect, housing 156 of assembly or module 150 may include one or more mechanisms or retaining devices configured to assist in retaining the positioning of projection 152 in housing 156, for example, retaining projection 152 within cavity 158 in housing 156. For example, as shown in FIGS. 17 and 18, housing 156 may include one or more "touch latches" 176, for example, magnetic touch latches. In one aspect, when the material of projection 152 is not ferromagnetic, a ferromagnetic contact 178 may be provided and positioned to engage touch latch 176. As known in the art, magnetic touch latch 178 may magnetically retain projection 152 in the retracted position, as shown in FIG. 17, and then when projection 152 is compressed against touch latch 176, touch latch 176 may resiliently deflect projection 152 to facilitate orienting projection 152 as desired by the user, for example, in the extended position shown in FIG. 18. In one aspect, touch latch 176 may be a touch latch provided by EPCO Hardware, for example, magnetic touch latch 512, or its equivalent. Other forms of latches, conventional retainers, and retainer hardware may be used for assembly 150 as will be apparent to those of skill in the art.

Figure 19:
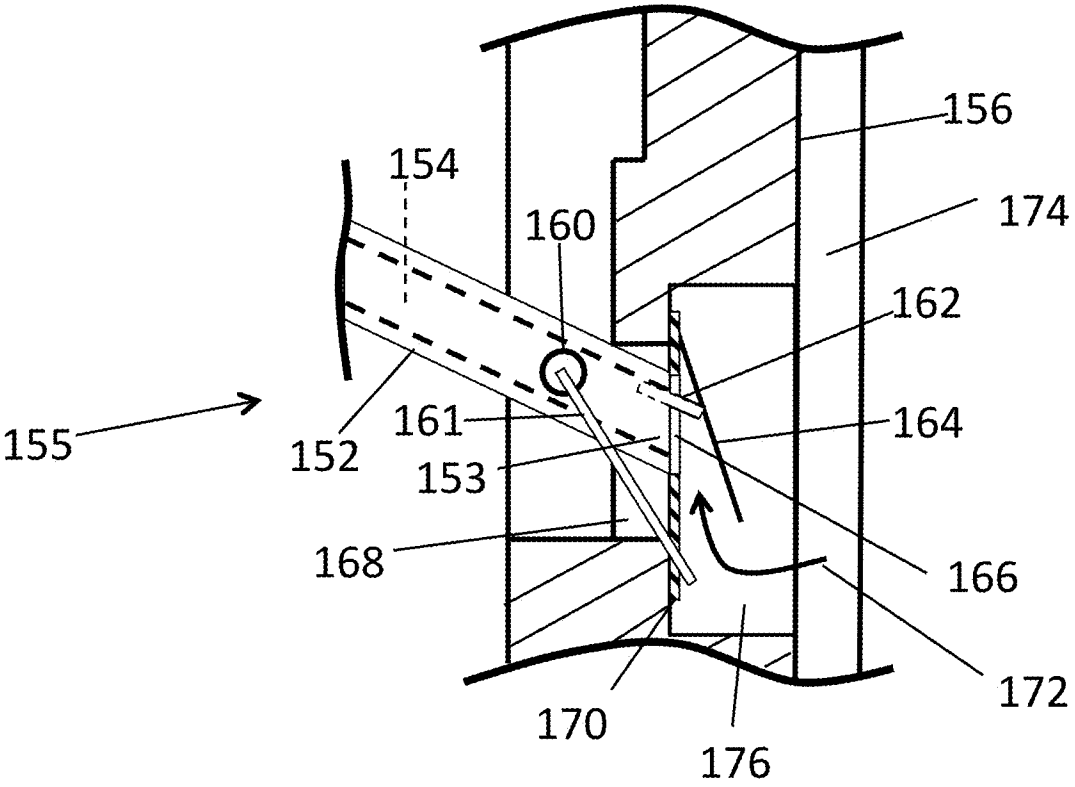
FIG. 19 is a detailed view of the proximal end of the projection shown in FIG. 18 as identified by Detail 19 shown in FIG. 18.

FIG. 19 is a detailed view of the proximal end 155 of the projection 152 shown in FIG. 18 as identified by Detail 19 shown in FIG. 18. As shown in FIG. 19, housing 156 includes a recess or cavity 168 into which the proximal end of projection 152 may rotate into, and a panel or plate 170 having a hole or orifice 166 mounted over and defining one end of recess 168, and positioned to be in fluid communication with open end 153 of projection 152. As also shown in FIG. 19, valve element or baffle 164 may be mounted to panel or plate 170 or to housing 156, and, with the rotation of projection 152, bar or pin 162 on projection 152 contacts and deflects baffle or reed valve 164 to expose hole or orifice 166 and allowing pressurized air, as indicated by arrow 172, to pass from passage 174 in housing 156 through hole 166, through open end 153, and into internal passage 154 of projection 152 and out of open end 155, to dry an apparel mounted on projection 152, as disclosed herein. In one aspect, as shown in FIG. 19, panel or plate 170 and baffle 164 may be mounted in a recess 176 in housing 156 which may typically be exposed to internal passage 174 of housing 156.

Figures 20, 21, 22, 23, 24, 25:
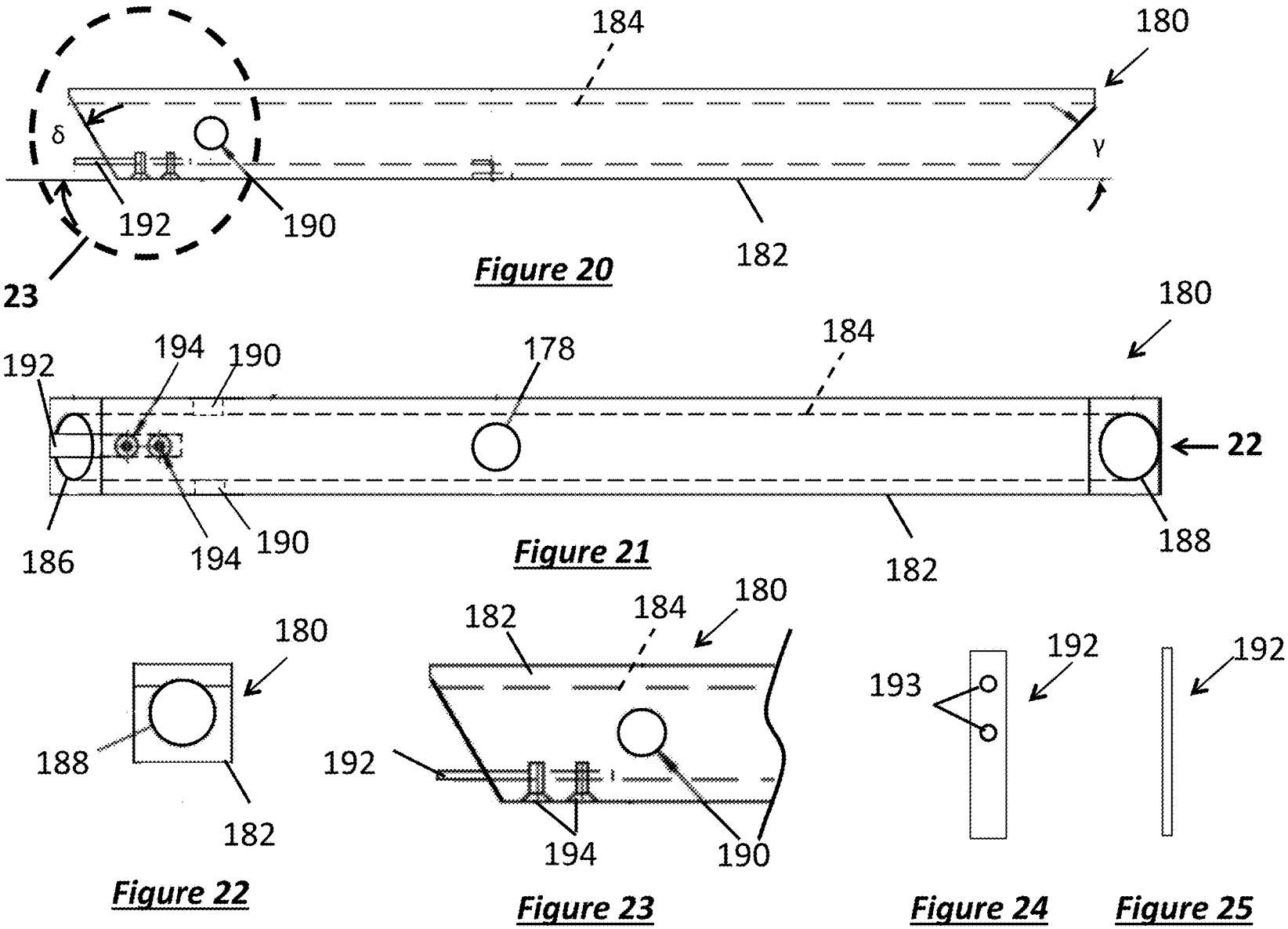
FIG. 20 is a side elevation view of one projection that may be used for the projection shown in the assembly of FIG. 17, and any projection disclosed herein, according to one aspect of the invention.
FIG. 21 is a front elevation view of the projection shown in FIG. 20.
FIG. 22 is a top view of the projection shown in FIG. 20 as viewed in the direction of Arrow 22 shown in FIG. 20.
FIG. 23 is a detailed view of the proximal end of the projection shown in FIG. 20 as identified by Detail 23 shown in FIG. 20.
FIG. 24 is a front elevation view of one projection that may be used for the projection shown in FIG. 20.
FIG. 25 is a side elevation view of the projection shown in FIG. 24.

FIG. 20 is a side elevation view of a projection 180 that may be used for the projection 152 shown in the assembly of FIGS. 17 and 18, and any projection disclosed herein, according to one aspect of the invention. FIG. 21 is a front elevation view of projection 180 shown in FIG. 20 and FIG. 22 is a top view of projection 180 shown in FIG. 20 as viewed in the direction of Arrow 22 shown in FIG. 21. As shown in FIGS. 20-22, projection 180 may typically be an elongated member 182 having an elongated internal cavity 184 having a proximal opening 186 and a distal opening 188.

As disclosed herein, the elongated member 182 may be fabricated from any convenient material, for example, from a metal, from a plastic, or from wood. In one aspect, elongated member 182 may be fabricated from wood, for example, a decorative hardwood, such as, cherry, oak, or maple. In another aspect, member 182 may be fabricated from aluminum or steel, for example, stainless steel, such as, 304 or 316 stainless steel. Though generally rectangular in cross section, for example, as shown in FIG. 20, member 182 may be fabricated in any conventional cross sectional shape, such as, circular, elliptical, and polygonal, including generally rectangular or square. Also, it is envisioned that, though elongated internal cavity 184 is shown generally circular in cross section, for example, as shown in FIG. 22, elongated internal cavity 184 may be provided in any conventional cross sectional shape, such as, circular, elliptical, and polygonal, including generally rectangular or square.

Elongated member 182 may have a length ranging from about 3 inches to about 4 feet, but typically has a length of between about 6 inches and about 18 inches, for example, about 12.75 inches. Elongated member 182 may have a width or diameter ranging from about 0.25 inches to about 6 inches, but typically has a width or diameter between about 0.75 inches and about 2 inches, for example, about 1.125 inches in width or diameter. The internal cavity 184 of elongated member 182 may have an internal width or internal diameter ranging from about 0.125 inches to about 5 inches, but typically has a width or diameter between about 0.50 inches and about 2 inches, for example about 0.75 inches in width or diameter.

As shown in FIG. 20, member 182 may have chamfered ends, for example, the distal end of member 182 may include a chamfer angle, $\gamma$ (gamma), and the proximal end of member 182 may include a chamfer angle, $\delta$ (delta). The chamfer angles, $\gamma$ and $\delta$, may be the same or vary, and may range from 5 degrees to 90 degrees (that is, substantially no chamfer), but typically range from about 15 degrees to about 60 degrees, for example, about 45 degrees.

According to aspects of the invention, member 182 includes at least one hole 190, for example, a through hole, positioned and sized to receive a dowel or pin, for example, about which member 182 may be rotatably mounted, for instance, pin 160 shown in FIGS. 17-19. Hole hole 190 may have a diameter ranging from about 0.125 inches to about 2 inches, but typically has a diameter of between about 0.25 inches and about 0.50 inches, for example, about 0.375 inches.

As also shown in FIGS. 20 and 21, according to aspects of the invention, member 182 includes at least one projection 192, for example, a bar, tab, or pin, positioned and sized to contact and deflect a valve element as disclosed herein, for example, pin 162 shown in FIGS. 17-19. FIG. 23 is a detailed view of the proximal end of member 182 shown in FIG. 20 as identified by Detail 23 shown in FIG. 20, and showing projection 192 and a typical mounting. Projection 192 may be mounted to elongated member 182, for example, to an internal surface of elongated internal cavity 184 or to an external surface of member 182, by any conventional means, for example, via one or more mechanical fasteners, an adhesive, welded, or formed integrally with member 182. In the aspect of the invention shown in FIGS. 20-23, projection 192 may be mounted to member 182 by a set of fasteners 194, for example, threaded fasteners or rivets.

FIG. 24 is a front elevation view of one projection 192 that may be used for the projection shown in FIGS. 20-23. FIG. 25 is a side elevation view of the projection 192 shown in FIG. 24. As shown in FIGS. 24 and 25, projection 192 may comprise a rectangular bar, though in other aspects, projection 1192 may be non-rectangular, for example, circular or elliptical in cross section. As shown in FIG. 24, projection 192 may have one or more through holes 193, for example, adapted to receive fasteners 194. Holes 193 may be threaded or non-threaded and may have a diameter ranging from about 0.050 inches to about 0.250 inches, but typically have a diameter of about 0.112 inches.

Projection 192 may be fabricated from a metal, a plastic, or wood, but typically is metallic, for example, made of aluminum or stainless steel. Projection 192 may typically have a length ranging from about 0.50 inches to about 5 inches, but typically ranges from about 1 inch to about 2 inches in length, for example, about 1.4375 inches in length. Projection 192 may typically have a width or diameter ranging from about 0.125 inches to about 2 inches, but typically ranges from about 0.125 inch to about 0.50 inches in width or diameter, for example, about 0.25 inches in width or diameter. Projection 192 may typically have a thickness ranging from about 0.03125 inches to about 0.50 inches, but typically ranges from about 0.3125 inches to about 0.25 inches in thickness, for example, about 0.0625 inches in thickness.

Figure 26:
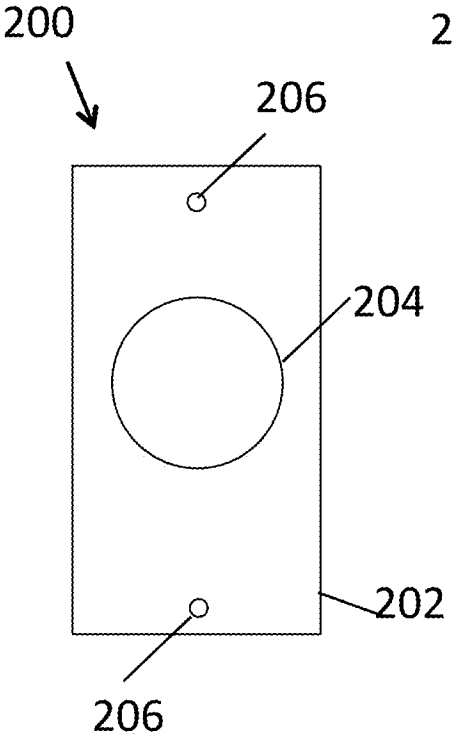
FIG. 26 is a plan view of a panel, plate, or valve seat plate that may be used for plate shown in FIGS. 17-19 according one aspect of the invention.

FIG. 26 is a plan view of a panel, plate, or valve seat plate 200 that may be used for plate 170 shown in FIGS. 17-19 according one aspect of the invention. As shown in FIG. 26, valve seat plate 200 may typically comprise a plate 202 having an orifice or opening 204 and one or more mounting holes 206. As shown most clearly in FIG. 19, valve seat plate 200 may typically mounted in housing 156 and provide opening 172/204 or "valve seat" that can be obstructed by valve element 164, for example, a deflectable baffle or flap.

Valve seat plate 200 may be made from a metal, a plastic, or wood. For example, in one aspect, valve seat plate 200 may be made of aluminum or steel, for example, stainless steel or spring steel.

In one aspect, orifice or opening 204 in plate 202 may be circular, as shown, or non-circular, for example, elliptical or polygonal, for example, rectangular or square. Orifice or opening 204 may typically have an internal dimension, width, or diameter, ranging from about 0.50 inches to about 5 inches, but typically ranges from about 1 inch to about 1.50 inches in internal dimension, for example, about 1.125 inches in internal dimension.

Though shown generally rectangular in FIG. 26, plate 202 may be circular, elliptic, or polygonal in shape. Plate 202 may typically have a length or diameter ranging from about 0.50 inches to about 8 inches, but typically ranges from about 1 inch to about 5 inches in length or diameter, for example, about 3.125 inches in length or diameter. Plate 202 may typically have a width ranging from about 0.5 inches to about 6 inches, but typically ranges from about 1 inch to about 2 inches in width, for example, about 1.625 inches in width. Plate 202 may have a thickness ranging from about 0.005 inches to about 1 inch, but typically ranges from about 0.005 inches to about 0.125 inches in length, for example, about 0.010 inches in thickness.

Figure 27:
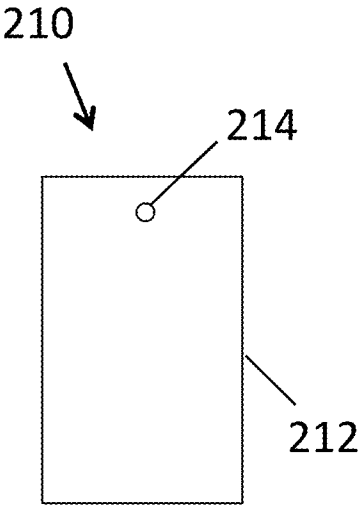
FIG. 27 is a plan view of the panel, plate, or valve seat plate shown in FIG. 26.

FIG. 27 is a plan view of a valve element 210, for example, a deflectable baffle, flap, or reed valve, which may be used for plate 164 shown in FIGS. 17-19 according one aspect of the invention. As shown in FIG. 27, valve element 210 may typically comprise a plate 212 having one or more mounting holes 214. As shown most clearly in FIG. 19, valve element 164/210 may typically be mounted in housing 156, for example, mounted onto valve seat 170, obstruct opening 166, and be deflectable by pin or projection 162 to at least partially remove the obstruction to opening 166.

Plate 212 of reed valve 210 may be made from a metal, a plastic, or wood. For example, in one aspect, plate 212 may be made of aluminum or steel, for example, stainless steel or spring steel.

Though shown generally rectangular in FIG. 27, plate 212 of reed valve 210 may be circular, elliptic, or polygonal in shape. Plate 210 may typically have a length or diameter ranging from about 0.50 inches to about 8 inches, but typically ranges from about 1 inch to about 5 inches in length or diameter, for example, about 2.25 inches in length or diameter. Plate 212 may typically have a width ranging from about 0.5 inches to about 6 inches, but typically ranges from about 1 inch to about 2 inches in width, for example, about 1.375 inches in width. Plate 212 may typically have a thickness ranging from about 0.005 inches to about 1 inch, but typically ranges from about 0.005 inches to about 0.125 inches in length, for example, about 0.010 inches in thickness.

FIG. 28 is a side elevation view of a spring wire assembly 220 which may be used to bias the position of projection 152 shown in FIGS. 17-19 according one aspect of the invention. FIG. 29 is a plan view of the spring wire assembly 220 shown in FIG. 28.

As shown in FIGS. 28 and 29, spring wire assembly 220 includes a u-shaped wire 222 and a set of pins 224 mounted to wire 222. According to aspects of the invention, pins 224 are positioned and sized to engage holes in projection 152, for example, holes 190 in elongated member 182 shown in FIG. 20, and bias the position of projection 152, for example, bias the position of projection 152 into the retracted position, for instance, as shown in FIG. 17. Pins 224 may include through holes 226 sized to receive wire 222. Wire 222 may be retained in holes 226 by deforming wire 222 and/or welding.

Wire 222 of spring wire assembly 220 may be made from a metal, for example, stainless steel or spring steel. Though shown generally rectangular in FIG. 29, wire 222 may be formed to any shape compatible with the shape of the projection, for example, projection 152, which spring wire assembly 220 is intended to engage. Wire 222 may be formed into circular, elliptic, or polygonal shape as needed. Wire 222 may typically have a diameter ranging from about 0.03125 inches to about 0.25 inches, but typically ranges from about 0.03125 inches to about 0.125 inches in diameter, for example, about 0.0625 inches in diameter.

Pins 224 of spring wire assembly 220 may be made from a metal or a plastic, but are typically metallic, for example, stainless steel or spring steel. Though shown generally circular cylindrical in FIG. 29, pins 224 may be formed to any shape compatible with the shape the holes in the projection that pins 224 are intended to engage. Pins 224 may be formed into circular, elliptic, or polygonal shape as needed. Pins 224 may typically have a diameter ranging from about 0.125 inches to about 0.75 inches, but typically from about 0.25 inches to about 00.50 inches in diameter, for example, about 0.375 inches in diameter. Pins 224 may typically have a length ranging from about 0.25 inches to about 3 inches, but typically range from about 0.50 inches to about 1.50 inches in diameter, for example, about 0.9375 inches in diameter.

Figure 32:
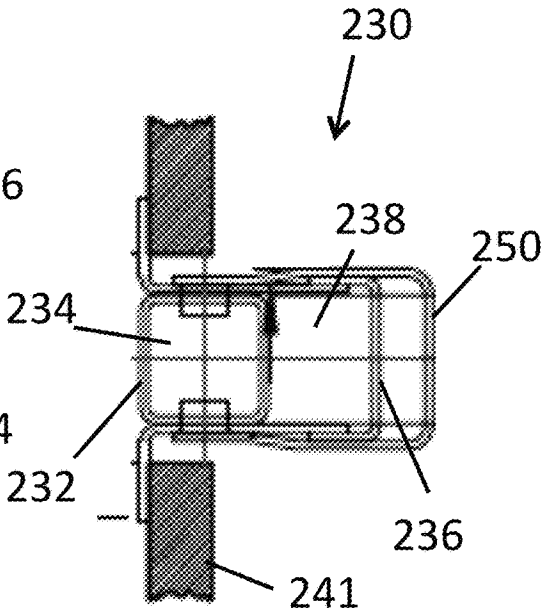
FIG. 32 is a cross-sectional view of the of the apparel drying assembly module shown in FIG. 31, as indicated by section view lines 32-32 shown in FIG. 31, as mounted, for example, within a wall, according to one aspect of the invention.
Figure 31:
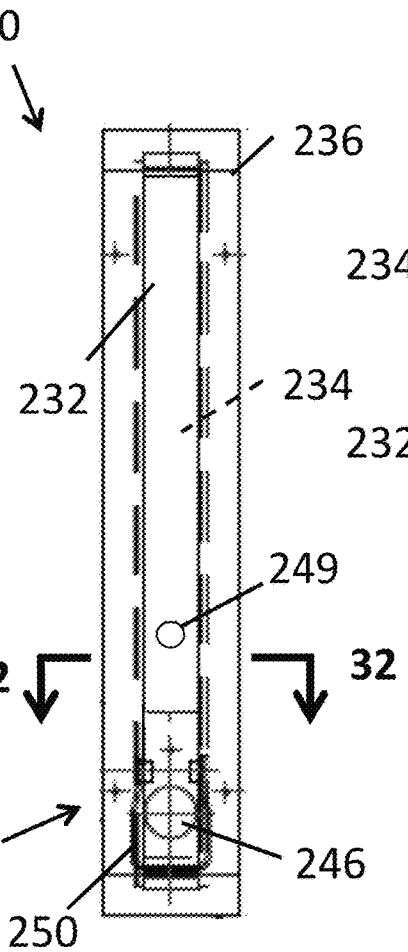
FIG. 31 is a front elevation view of the apparel drying assembly module shown in FIG. 30, with the projection in the retracted position.
Figure 30:
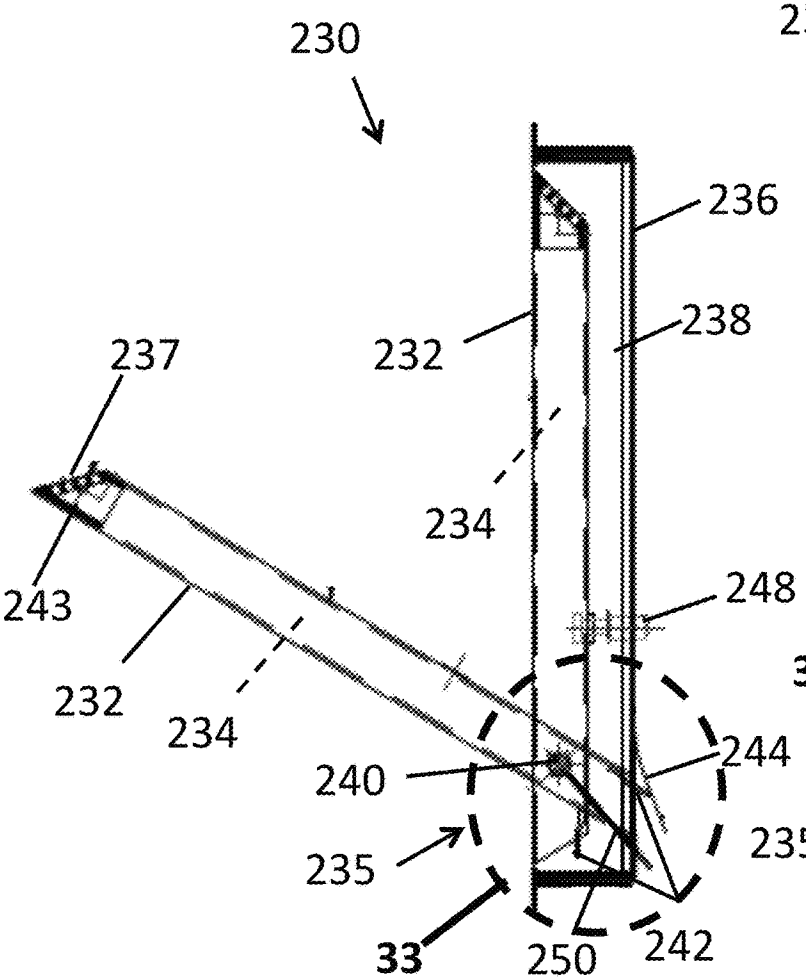
FIG. 30 is a side elevation view, partially in cross section, of an apparel drying assembly module according to another aspect of the invention, with a projection in an extended position and in a retracted position.

FIG. 30 is a side elevation view, partially in cross section, of an apparel drying assembly or module 230 according to another aspect of the invention, with a projection 232 in an extended position and in a retracted position. FIG. 31 is a front elevation view of the apparel drying assembly or module 230 shown in FIG. 30, with the projection 232 in the retracted position. FIG. 32 is a cross-sectional view of the of the apparel drying assembly or module 230 shown in FIG. 31, as indicated by section view lines 32-32 shown in FIG. 31, as mounted, for example, within a wall, according to one aspect of the invention.

Also similar to other aspects disclosed herein, assembly or module 230 may be provided as a subassembly, an assembly, or a projection module 230 mounted in a wall or a panel 241, as shown in FIG. 32, for example, into the assemblies shown in FIGS. 42-45.

Similar to other aspects of the invention disclosed herein, projection or "peg" 232 of module 230 shown in FIGS. 30-32 includes an internal passage 234 having an open distal end 237, an open proximal end 239 (see FIG. 33), and is operatively connected to a source of pressurized air. In one aspect, projection 232 may include one or more air flow diffusing element 243, for example, a device having a plurality of holes or orifices adapted to improve the distribution and/or increase the velocity of flow of air from open distal end 237. Projection 232 may be pivotally mounted at a proximal end 235 to a housing 236, for pivotally rotating projection 232 into and out of a cavity or recess 238 in housing 236. According to this aspect, projection 232 may be pivotally mounted to housing 236 by pin or dowel 240. As disclosed herein, pressurized air may be passed through internal passage 234 and directed out of open distal end 237 to dry a piece of apparel (not shown) mounted to projection 232.

In the aspect of the invention, shown in FIGS. 30-32, pivotally mounted projection 232 includes an extension 242 from proximal end 235, and the extension 242 is positioned and adapted to deflect a valve element 244 when the pivotally mounted projection 232 is at least partially rotated into an extend position, as shown in FIG. 30, for example, a position adapted to receive the apparel (not shown). In one aspect, the extension 242 of proximal end 235 may comprise an extension of the pivotally mounted projection 232, or a projection, a tab, a pin, a rod, a bar, or a related structure mounted to the proximal end 235 of projection 232. In the aspect of the invention shown in FIGS. 30 and 31, the extension 242 may comprise one or more bars or pins.

According to aspects of the invention the extension 242, for example, a bar or pin, on the proximal end 235 of projection 232 may be positioned and adapted to engage any form of valve element is deflected where pressurized air provided to housing 236 is provided to the internal passage 234 of projection 232. In the aspect of the invention shown in FIGS. 30 and 31, housing 236 includes one or more deflectable baffles, flaps, or reed valves 244 positioned over a hole or orifice 246 in housing 236. A detail of the deflection of one valve element according to one aspect of the invention is shown in FIG. 33.

In one aspect, housing 236 of assembly 230 may include one or more mechanisms to assist in retaining the positioning of projection 232 in housing 236, for example, retaining projection 236 within cavity 238 in housing 236. For example, as shown in FIGS. 30 and 31, housing 236 may include one or more "touch latches" 248, for example, magnetic touch latches. In one aspect, when the material of projection 232 is not ferromagnetic, a ferromagnetic contact 249 may be provided and positioned to engage touch latch 248. As known in the art, magnetic touch latch 248 may magnetically retain projection 232 in the retracted position, as shown in FIG. 31, and then when projection 232 is compressed against touch latch 248, touch latch 248 may resiliently deflect projection 232 to facilitate orienting projection 232 as desired by the user, for example, in the extended position shown in FIG. 30. In one aspect, touch latch 248 may be a touch latch provided by EPCO Hardware, for example, magnetic touch latch 512, or its equivalent. Other forms of latches, conventional retainers, and retainer hardware may be used for assembly 230 as will be apparent to those of skill in the art.

In one aspect, projection 232 may be pivotally mounted to housing 236 with one or more biasing elements 250, for example, an elastomeric element or spring element adapted to bias the positioning of projection 232, for example, biased into the retracted position shown in FIGS. 30 and 31. In one aspect, the biasing element may be associated with dowel or pin 240 and bias the positioning of projection 232 into the retracted position. One biasing element that may be used may be the spring wire assembly 220 shown in and described with respect to FIGS. 28 and 29, thought other types of biasing elements may be used.

Figure 33:
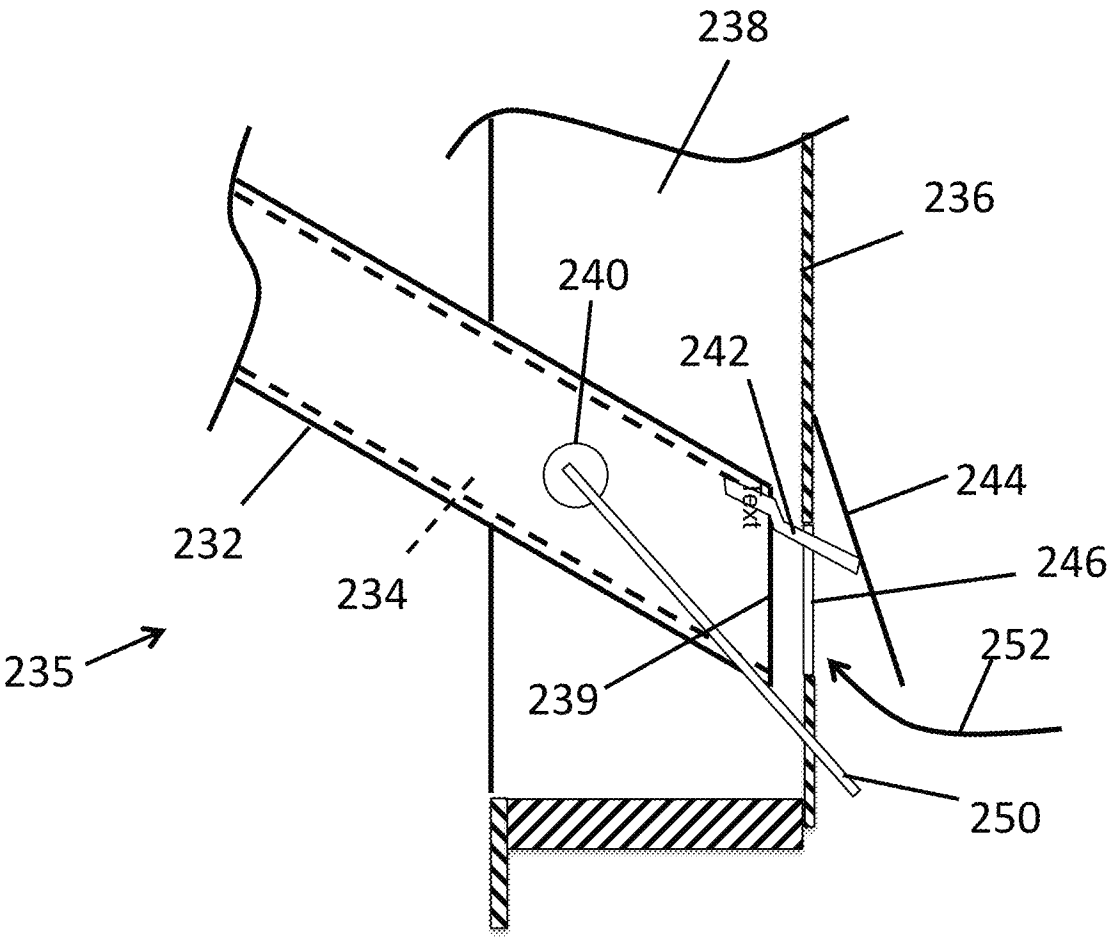
FIG. 33 is a detailed view of the proximal end of the projection of the module shown in FIG. 30 as identified by Detail 33 shown in FIG. 30, showing the projection in the extended position.

FIG. 33 is a detailed view of the proximal end 235 of the projection 232 of module 230 shown in FIG. 30 as identified by Detail 33 shown in FIG. 30, showing the projection 232 in an extended position. As shown in FIG. 33, housing 236 includes a recess or cavity 238 into which the proximal end 255 of projection 232 may rotate into. Projection 232 may be pivotally mounted to housing 236 by biasing element 250. As shown in FIG. 33, housing 236 includes a hole or orifice 246. In the aspect shown, valve element, for example, a baffle or reed valve, 244 may be mounted to housing 236, and, with the rotation of projection 232, projection, bar, or pin 242 on projection 232 contacts and deflects valve element 244 to expose hole or orifice 246 and allow pressurized air, as indicated by arrow 252, to pass through open proximal end 239 and into internal passage 234 of projection 232, and out of open end 237, to dry an apparel mounted on projection 232, as disclosed herein.

Figure 34:
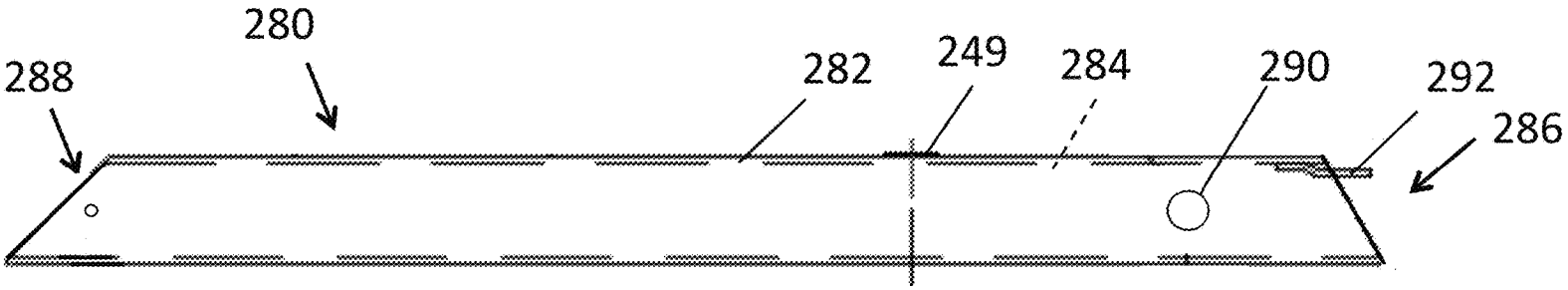
FIG. 34 is a side elevation view of a projection that may be used for the projection shown in the assembly of FIGS. 31-33, and any projection disclosed herein, according to one aspect of the invention.
Figure 35:
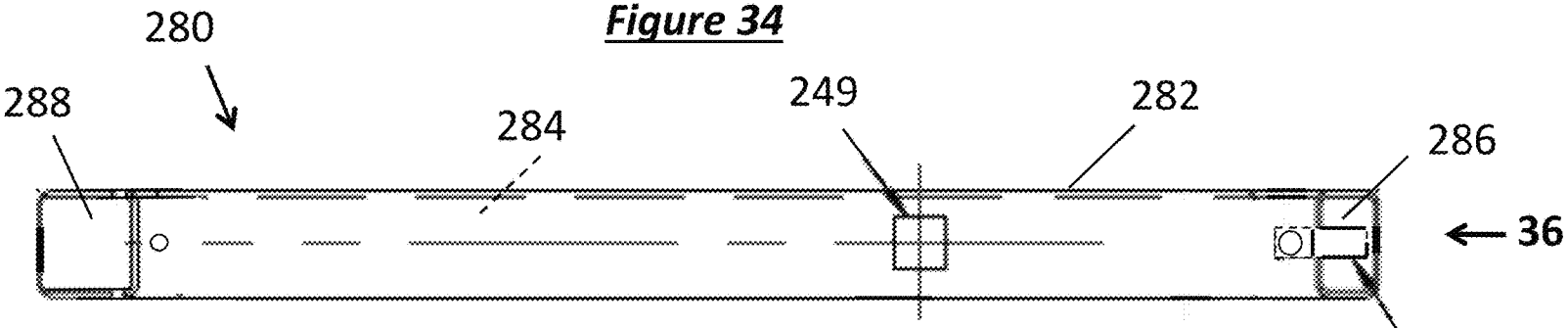
FIG. 35 is a front elevation view of the projection shown in FIG. 34.
Figure 36:
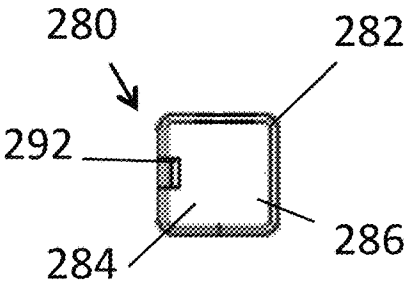
FIG. 36 is a top view of the projection shown in FIG. 35 as viewed in the direction of Arrow 36 shown in FIG. 35.

FIG. 34 is a side elevation view of a projection 280 that may be used for the projection 232 of assembly or module 230 shown in FIGS. 31-33, and any projection disclosed herein, according to one aspect of the invention. FIG. 35 is a front elevation view of projection 280 shown in FIG. 34, and FIG. 36 is a top view of projection 280 shown in FIG. 35 as viewed in the direction of Arrow 36 shown in FIG. 35. As shown in FIGS. 34-36, projection 280 may typically be an elongated member 282 having an elongated internal cavity 284 having a proximal opening 286 and a distal opening 288.

As disclosed herein, the elongated member 282 may be fabricated from any convenient material, for example, from a metal, from a plastic, or from wood. In one aspect, elongated member 282 may be fabricated from a metal, for example, aluminum or steel, for example, stainless steel, such as, 304 or 316 stainless steel. In one aspect, elongated member 282 may be fabricating from metal pipe or tubing. Though generally rectangular in cross section, for example, as shown in FIG. 36, member 282 may be fabricated in any conventional cross sectional shape, including circular, elliptical, and polygonal, including generally rectangular or square. Also, it is envisioned that, though elongated internal cavity 284 is shown generally rectangular in cross section, for example, as shown in FIG. 36, elongated internal cavity 284 may be provided in any conventional cross sectional shape, including circular, elliptical, and polygonal, including generally rectangular or square.

Elongated member 282 may have a length ranging from about 3 inches to about 4 feet, but typically has a length of between about 6 inches and about 18 inches, for example, about 12.625 inches. Elongated member 282 may have a width or diameter ranging from 0.25 inches to 6 inches, but typically has a width or diameter between about 0.75 inches and 2 inches, for example about 1 inch in width or diameter. The internal cavity 184 of elongated member 182 may have an internal width or internal diameter ranging from 0.125 inches to 5 inches, but typically has a width or diameter between about 0.50 inches and 2 inches, for example about 0.75 inches in width or diameter. The wall thickness of elongated member 282 may range from 0.03125 inches to 0.5 inches, but typically has a wall thickness between about 0.03125 inches and 0.125 inches, for example about 0.0625 inches in wall thickness.

As shown in FIG. 34, member 282 may have chamfered ends, for example, similar to the chamfered ends of elongated member 182 shown in FIG. 20. For example, member 282 may have chamfered ends having chamfer angles that may range from 5 degrees to 90 degrees (that is, substantially no chamfer), but typically range from about 15 degrees to about 60 degrees, for example, about 45 degrees.

According to aspects of the invention, member 282 includes at least one hole 290, for example, a through hole, positioned and sized to receive a dowel or pin, for example, about which member 282 may be rotatably mounted, for instance, pin 240 shown in FIG. 30. Hole 290 may have a diameter ranging from about 0.125 inches to about 2 inches, but typically has a diameter of between about 0.25 inches an about 0.50 inches, for example, about 0.375 inches.

As also shown in FIGS. 34-36, according to aspects of the invention, member 282 includes at least one projection 292, for example, a bar, tab, or pin, positioned and sized to contact and deflect a valve element as disclosed herein, for example, projection 242 shown in FIG. 30. Projection 292 may be mounted to elongate member 282, for example, to an internal surface of elongated internal cavity 284 or to an external surface of member 282, by any conventional means, for example, via one or more mechanical fasteners, an adhesive, welded, or formed integrally with member 282. In the aspect of the invention shown in FIGS. 34-36, projection 292 may be mounted to member 282 by a weld, for example, ¼-inch plug weld.

Figure 38:
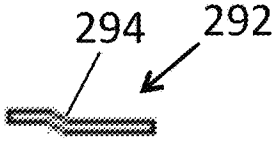
FIG. 38 is a side elevation view of the projection shown in FIG. 37.
Figure 37:
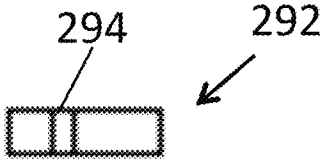
FIG. 37 is a plan view of one projection that may be used for the projection shown in FIGS. 34-36.

FIG. 37 is a plan view of one projection 292 that may be used for the projection shown in FIGS. 34-36. FIG. 38 is a side elevation view of the projection 192 shown in FIG. 37. As shown in FIGS. 37 and 38, projection 292 may comprise a rectangular bar, though in other aspects, projection 292 may be non-rectangular, for example, circular or elliptical in cross section. As shown in FIG. 37, projection 292 may have a "jog" or "kink" 294 to better conform to the shape of elongated member 282 and/or a desired positioning of projection 192; however, in other aspects, no kink may be provided.

Projection 292 may be fabricated from a metal, a plastic, or wood, but typically is metallic, for example, made of aluminum or stainless steel. Projection 292 may typically have a length ranging from about 0.25 inches to about 5 inches, but typically ranges from about 0.50 inch to about 2 inches in length, for example, about 0.875 inches in length. Projection 292 may typically have a width or diameter ranging from about 0.125 inches to about 2 inches, but typically ranges from about 0.125 inch to about 0.50 inches in width or diameter, for example, about 0.25 inches in width or diameter. Projection 292 may typically have a thickness ranging from about 0.03125 inches to about 0.50 inches, but typically ranges from about 0.3125 inches to about 0.25 inches in thickness, for example, about 0.0625 inches in thickness.

Figure 40:
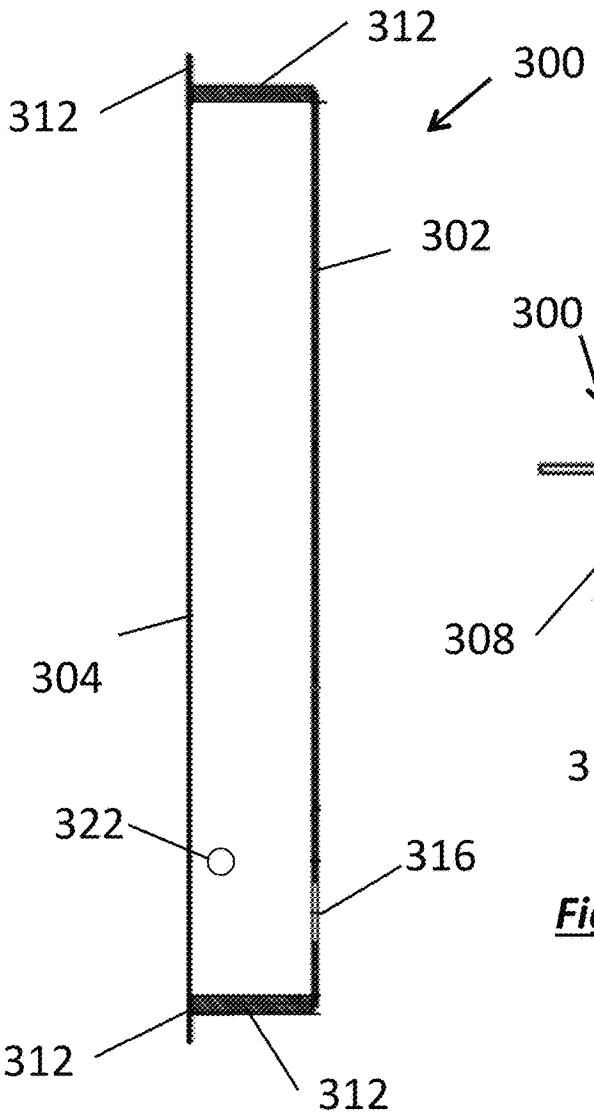
FIG. 40 is a side elevation view of the housing shown in FIG. 39.
Figure 39:
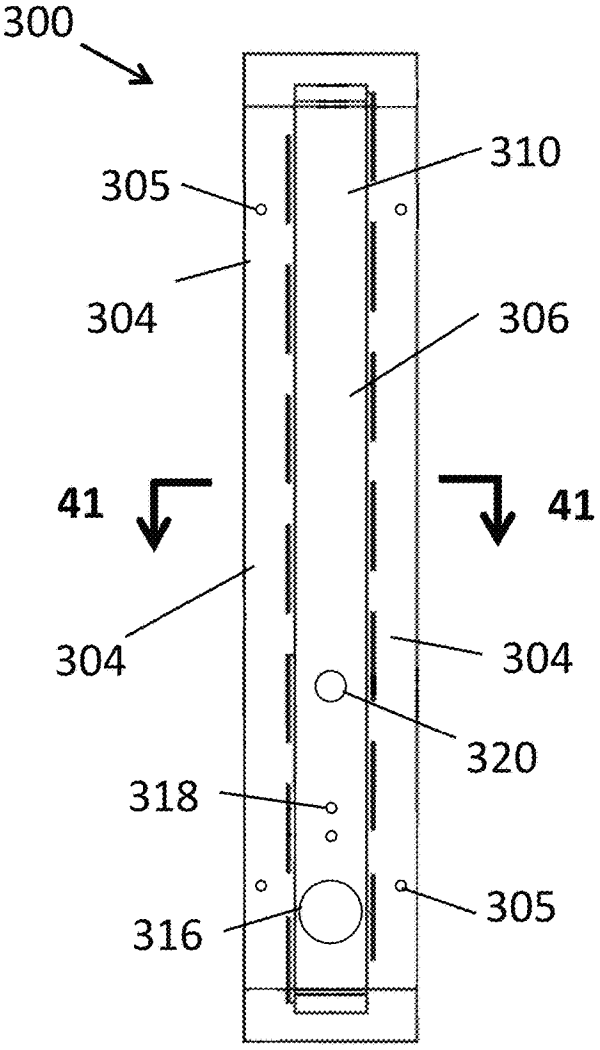
FIG. 39 is a front elevation view of a housing that may be used for the housing shown in FIGS. 30-33, according to one aspect of the invention.

FIG. 39 is a front elevation view of a housing 300 that may be used for housing 236 shown in FIGS. 30-33, according to one aspect of the invention. FIG. 40 is a side elevation view of housing 300 shown in FIG. 39, and FIG. 41 is cross sectional view of housing 300 shown in FIG. 39 as viewed along section lines 41-41 in FIG. 39.

As shown in FIG. 39, housing 300 may typically include a main body 302 and a flange 304 mounted to main body 302. According to aspects of the invention, main body 302 includes a cavity or recess 306 into which a projection, for example, projection 232 shown in FIGS. 30-33, may be mounted, for example, pivotally mounted as disclosed herein. Flange 304 may typically include a plurality of mounting holes 305, for example, for mounting housing 300 to a wall or panel, as disclosed herein, for instance. for mounting into the panels disclosed in FIGS. 42-45. According to aspects of the invention, main body 302 and flange 304 may be provided by any conventional construction, for example, piece parts assembled by welding, mechanical fasteners, or an adhesive, or as one or more integral components fabricated by, for example, forging, extrusion, and/or machining. According to aspects o the invention, housing 300 may be made from a metal, a plastic, or wood. For example, in one aspect, housing 300 may be fabricated from carbon steel and/or stainless steel components to yield the desired housing shown in FIGS. 39-41.

As shown in FIG. 39, housing 300 may typically include an orifice or hole 316 which may function as a valve seat for a valve element, for example, for reed valve 244 shown in FIG. 33. Housing 300 may also include one or more mounting holes 318, for example, for mounting a valve element to housing 300, for example, for mounting reed valve 244 to over hole 316. Housing 300 may also include one or more holes 320, for example, for mounting a retaining device, for example, touch latch 248 shown in FIG. 30 to housing 300. As shown in FIG. 40, housing 300 may typically include opposing hole 322 in the opposing sides of housing 300 positioned and adapted to receive a projection mounting pin, for example, to receive the pins of spring wire assembly 220 shown in FIG. 29.

Figure 41:
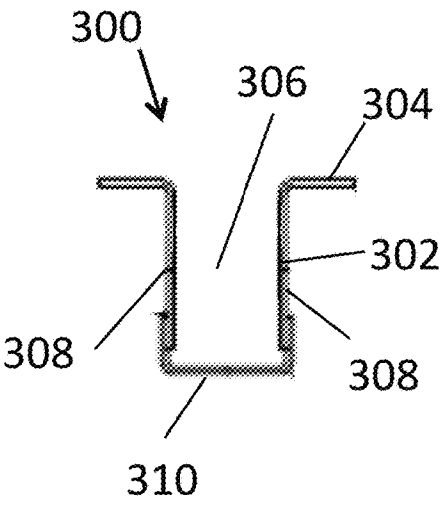
FIG. 41 is cross sectional view of the housing shown in FIG. 39 as viewed along section lines 41-41 in FIG. 39.

Again, though many means of fabricating housing 300 are envisioned according to aspects of the invention, in the embodiment shown in FIGS. 39-41, as most clearly shown in FIG. 41, housing 300 may be fabricated by assembling angles 308 and one or more channels 310. Angles 308 and channels 310 may be stock angles and/or channels and/or formed angles and/or formed channels, for example, angles and/or channels formed from metal plate or plastic sheets. Angles 308 and channels 310 may have a thickness ranging from 0.03125 inches to 0.25 inches, for example, about 0.0625 inches. Angles 304 and channels 306 may be assembled via welding, an adhesive, or mechanical fasteners.

As most clearly shown in FIG. 40, housing 300 may also be fabricated with end plates 312 and end flanges 314, for example, assembled to angles 308 and channels 310 by welding, an adhesive, or mechanical fasteners. End flanges 314 may have a thickness ranging from about 0.03125 inches to about 0.25 inches, for example, about 0.0625 inches. End plates 312 may have a thickness ranging from about 0.125 inches to about 0.5 inches, for example, about 0.25 inches.

Main body 302 of housing 300 may typically have a length ranging from about 3 inches to about 3 feet, but typically ranges from about 8 inches to about 16 inches in length, for example, about 13.375 inches in length. Main body 302 may typically have a width ranging from about 0.5 inches to about 6 inches, but typically ranges from about 0.50 inches to about 1.50 inches in width, for example, about 1 inch in width. Main body 302 may typically have a depth ranging from about 0.50 inches to about 6 inches, but typically ranges from about 0.50 inches to about 3.0 inches in depth, for example, about 1.75 inches in depth.

Figure 43:
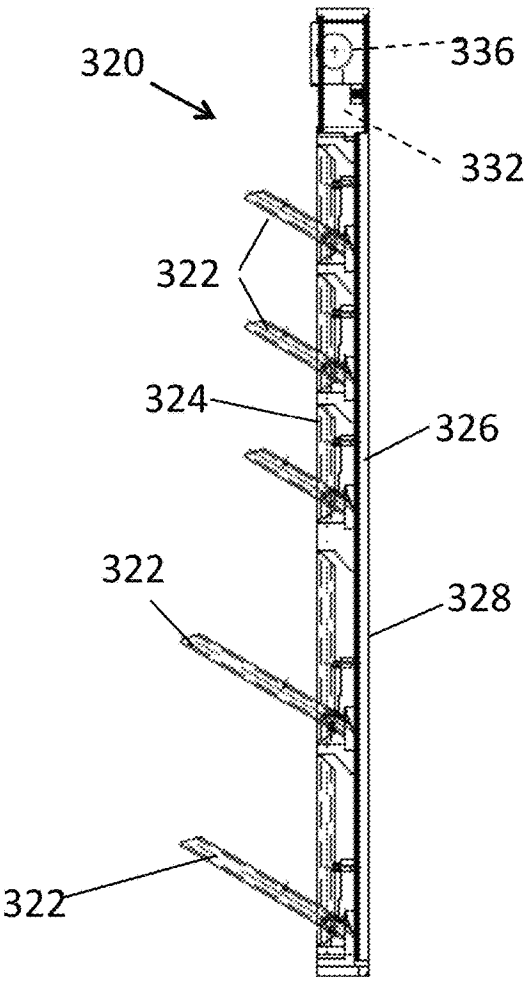
FIG. 43 is a side elevation view of the assembly shown in FIG. 42 having projections oriented in an extended position according to an aspect of the invention.
Figure 42:
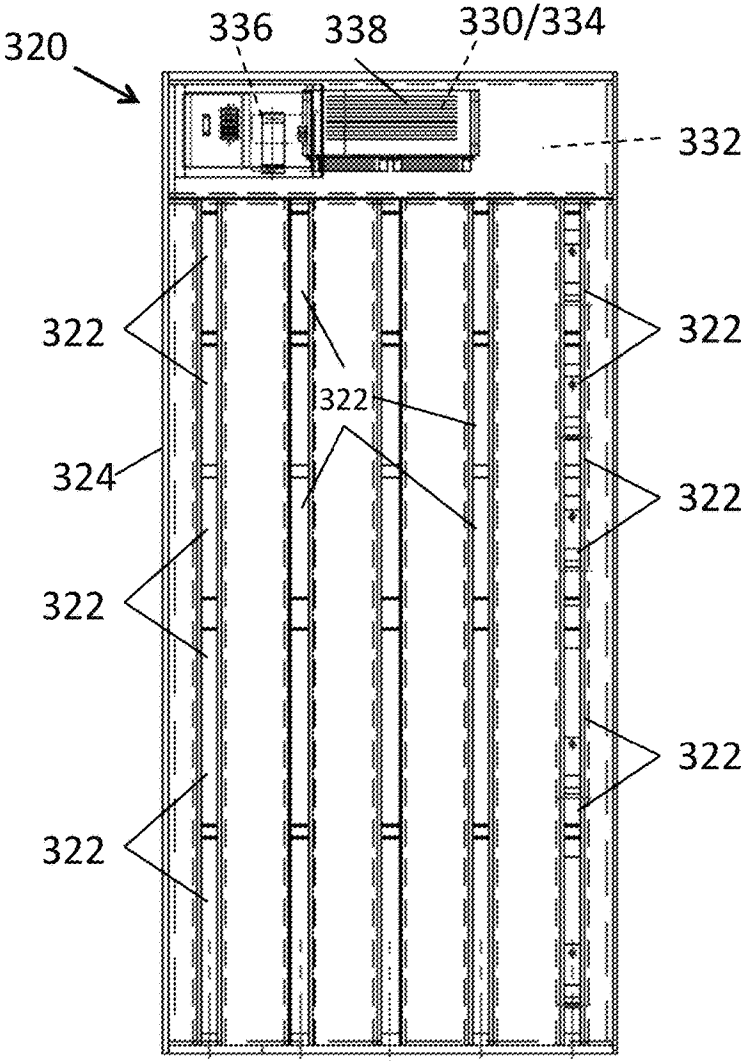
FIG. 42 is a front elevation view of an assembly or panel assembly having a plurality of pivotally-mounted projections according to one aspect of the invention.

FIG. 42 is a front elevation view of an assembly or panel assembly 320 having a plurality of pivotally mounted projections 322 according to one aspect of the invention. FIG. 43 is a side elevation view of assembly 320 shown in FIG. 42 having projections 322 oriented in an extended position according to an aspect of the invention. According to this aspect of the invention, assembly 320 includes a housing or panel 324 adapted to receive the pivotally-mounted projections 322 or projection modules disclosed herein and provide a flow of pressurized air, for example, heated drying air, to the plurality of projections 322, in a fashion disclosed herein. In one aspect of the invention, at least one of the projections 322 may not be pivotally mounted, but may be rigidly mounted in panel 324.

Projections 322 may be mounted to panel 324 and may function as disclosed herein. Projections 322 may be mounted to panel 324 by conventional means, for example, with appropriate hardware, welded, and/or with an adhesive. Projections 322 may also preferably be mounted to panel 324 by any one or more of the mounting means disclosed herein. For example, one or more of the projections 322 may comprise any projection and its mounting, function, and operation disclosed herein. For instance, one or more of the projections 322 may be mounted and have the function, operation, materials, and dimensions of projection 16 disclosed in and described with respect to FIGS. 3-9; one or more of the projections 322 may be mounted and have the function, operation, material, and dimensions of projection 84 disclosed in and described with respect to FIG. 10; one or more of the projections 322 may be mounted and have the function, operation, materials, and dimensions of projection 106 disclosed in and described with respect to FIGS. 11 and 12; one or more of the projections 322 may have the mounting and have the function, operation, materials, and dimensions of projection 152 disclosed in and described with respect to FIGS. 17 and 18; and/or one or more of the projections 322 may have the mounting and have the function, operation, materials, and dimensions of projection 232 disclosed in and described with respect to FIG. 30-33.

As shown most clearly in FIG. 43, one or more of the projections 322 may vary in length.

According to the aspect shown in FIGS. 42 and 43, panel or housing 324 of assembly 320 may be adapted to deliver a flow of pressurized air to at least some, but, typically, most of projections 322. For example, in one aspect, panel 324 may include one or more internal passages, ducts, or channels adapted to transmit a flow of pressurized air to the open ends (as disclosed herein) of at least some of the projections 322. In one aspect, panel 324 may include an internal passage or chamber 326, for example, a chamber 326 at least partially defined by a back panel 328, that is in fluid communication with the open ends of projections 322, for example, via a valve mechanism, such as, the reed valves shown in FIG. 19 or 33.

In one aspect, a source of pressurized air, for example, a fan or blower, may be mounted in assembly 320, for example, at the top, bottom, front, rear, or sides of panel 324, and communicate a flow of pressurized air to one or more of projections 322. In one aspect, the flow of pressurized air may be heated and/or dehumidified.

In the aspects of the invention shown in FIGS. 42 and 43, panel assembly 320 includes at least one source of pressurized air 330 mounted in a cavity 332 in the top of panel assembly 320. In one aspect, this source of pressurized air 330 may be a fan 334 driven by an electric motor 336, and the fan 332 having an inlet 338 in communication with the ambient air, for example, room air, and an outlet operatively communicating with the internal passage 326, for example, via internal cavity 332. Ambient air may be drawn into fan 334 via an appropriate grating 338, for example, a decorative grating. Motor 336 may be provided with appropriate electrical power, for example, a power cord hardwired to a source of electrical power or a power cord adapted to be plugged into an electrical outlet.

The panel 324 and the projections 322 may be fabricated from a metal, a plastic, and/or a wood. In one aspect, panel 324 any projections 322 may be fabricated from a decorative hardwood, for example, a maple, an oak, or a cherry, to provide a more aesthetically appealing appearance.

In one aspect, assembly 320 may be mounted to a surface of barrier or wall or may at least partially be imbedded in a barrier or wall, for example, to minimize intrusion of the assembly into a living or work space. For example, in one aspect, assembly 320 may be mounted in a wall where the front surface of assembly 320 is flush with the wall or barrier, or may protrude only slightly from the surface of the wall. Assembly 320 may be mounted to the barrier or wall by conventional means, for example, with mechanical fasteners.

The size of assembly 320 may vary depending upon the desired installation and, for example, the number of projections 322 desired. In one aspect, panel assembly 320 may have a height ranging from about 3 feet to about 20 feet, but is typicality between about 4 feet and about 8 feet in height, for example, about 5.5 feet in height. In one aspect, panel assembly 320 may have a width ranging from about 6 inches to about 10 feet, but is typicality between about 2 feet and about 5 feet in width, for example, about 2.5 feet in width. In one aspect, panel assembly 320 may have a depth ranging from 2 inches to about 2 feet, but typicality is between about 2 inches and about 1 foot in depth, for example, about 3.5 inches in depth.

Figure 45:
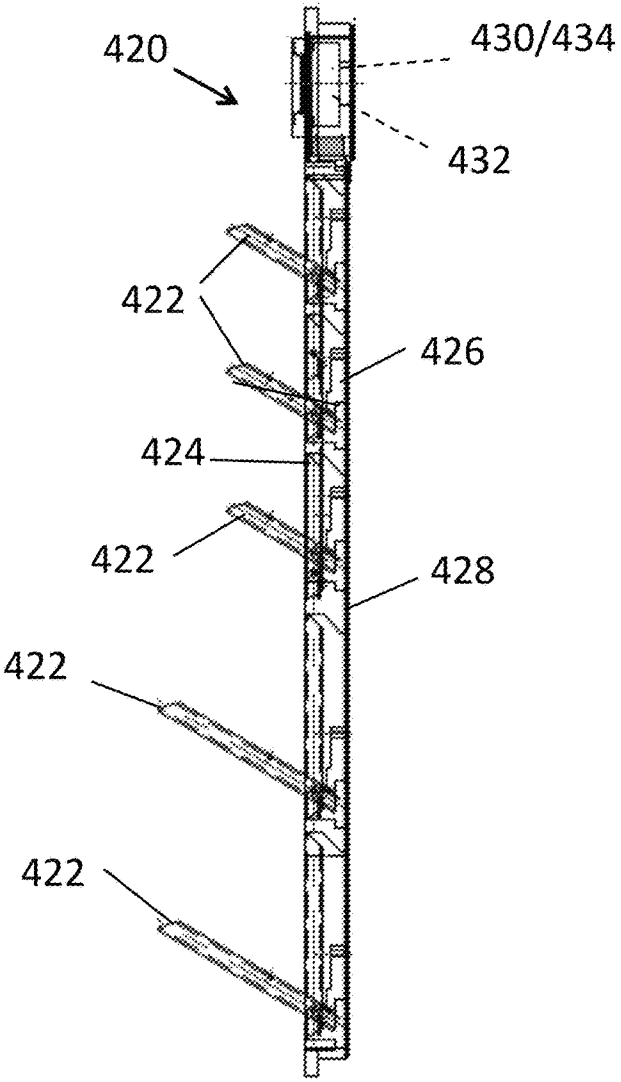
FIG. 45 is a side elevation view of the assembly shown in FIG. 44 having projections oriented in an extended position according to an aspect of the invention.
Figure 44:
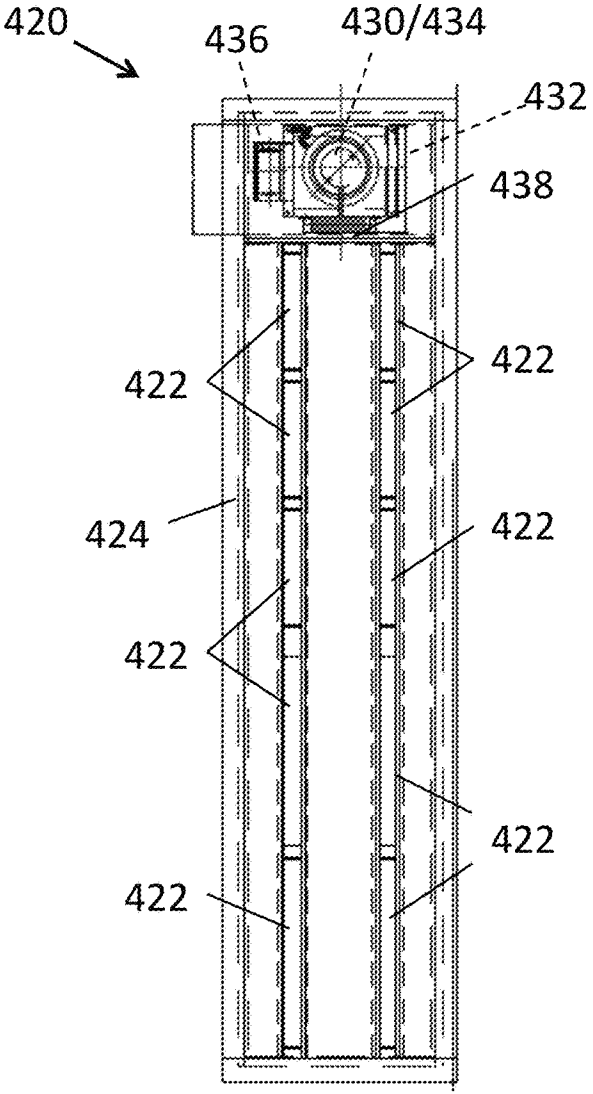
FIG. 44 is a front elevation view of another assembly or panel assembly having a plurality of pivotally-mounted projections according to another aspect of the invention.

FIG. 44 is a front elevation view of another assembly or panel assembly 420 have a plurality of pivotally-mounted projections 422 according to another aspect of the invention. FIG. 45 is a side elevation view of assembly 420 shown in FIG. 44 having projections 422 oriented in an extended position according to an aspect of the invention. According to this aspect of the invention, assembly 420 includes a housing or panel 424 adapted to receive the pivotally-mounted projections 422 and provide a flow of pressurized air, for example, heated drying air, to the plurality of projections 422, in a fashion disclosed herein. In one aspect of the invention, at least one of the projections 442 may not be pivotally mounted, but may be rigidly mounted in panel 424.

Projections 422 may be mounted to panel 424 and may function as disclosed herein. Projections 422 may be mounted to panel 424 by conventional means, for example, with appropriate hardware and/or an adhesive. Projections 422 may also preferably be mounted to panel 424 by any one or more of the mounting means disclosed herein. For example, one or more of the projections 422 may comprise any projection and its mounting, function, and operation disclosed herein. For instance, one or more of the projections 422 may be mounted and have the function, operation, materials, and dimensions of projection 16 disclosed in and described with respect to FIGS. 3-9; one or more of the projections 422 may be mounted and have the function, operation, material, and dimensions of projection 84 disclosed in and described with respect to FIG. 10; one or more of the projections 422 may be mounted and have the function, operation, materials, and dimensions of projection 106 disclosed in and described with respect to FIGS. 11 and 12; one or more of the projections 422 may have the mounting and have the function, operation, materials, and dimensions of projection 152 disclosed in and described with respect to FIGS. 17 and 18; and/or one or more of the projections 422 may have the mounting and have the function, operation, materials, and dimensions of projection 232 disclosed in and described with respect to FIG. 30-33.

As shown most clearly in FIG. 45, one or more of the projections 422 may vary in length.

According to the aspect shown in FIGS. 44 and 45, panel or housing 424 of assembly 420 may be adapted to deliver a flow of pressurized air to at least some, but, typically, most of projections 422. For example, in one aspect, panel 424 may include one or more internal passages, ducts, or channels adapted to transmit a flow pressurized air to the open ends (as disclosed herein) of at least some of the projections 422. In one aspect, panel 424 may include an internal passage or chamber 426, for example, a chambers 426 at least partially defined by a back panel 428, that is in fluid communication with the open ends of projections 422, for example, via a valve mechanism, such as, the reed valve shown in FIG. 19 or 33.

In one aspect, a source of pressurized air, for example, a fan or blower, may be mounted in assembly 420, for example, at the top, bottom, front, rear, or sides of panel 424, and communicate a flow of pressurized air to one or more of projections 422. In one aspect, the flow of pressurized air may be heated and/or dehumidified.

In the aspects of the invention shown in FIGS. 44 and 45, panel assembly 420 includes at least one source of pressurized air 430 mounted to a cavity 432 in the top of panel assembly 420. In one aspect, this source of pressurized air 430 may be a fan 434 driven by a motor 436, and the fan 432 having an inlet 438 in communication with the ambient air, for example, room air, and an outlet operatively communicating with internal passages 426, for example, via internal cavity 432. Ambient air may be drawn into fan 434 via an appropriate grating 438, for example, a decorative grating. Motor 436 may be provided with appropriate electrical power, for example, a power cord hardwired to a source of electrical power or a power cord adapted to be plugged into an electrical outlet.

The panel 424 and the projections 422 may be fabricated from a metal, a plastic, and/or a wood. In one aspect, panel 424 any projections 422 may be fabricated from a metal, such as, stainless steel or aluminum.

In one aspect, assembly 420 may be mounted to a surface of a barrier or wall or may at least partially be imbedded in a barrier or wall, for example, to minimize intrusion of the assembly into a living or work space. For example, in one aspect, assembly 420 may be mounted in a wall where the front surface of assembly 420 is flush with the wall or barrier, or may protrude only slightly from the surface of the wall. Assembly 420 may be mounted to the barrier or wall by conventional means, for example, with mechanical fasteners.

The size of assembly 420 may vary depending upon the desired installation and, for example, the number of projections 422 desired. In one aspect, panel assembly 420 may have a height ranging from about 3 feet to about 20 feet, but is typicality between about 4 feet and about 8 feet in height, for example, about 5.5 feet in height. In one aspect, panel assembly 420 may have a width ranging from about 6 inches to about 10 feet, but is typicality between about 2 feet and about 5 feet in width, for example, about 13.5 inches in width. In one aspect, panel assembly 420 may have a depth ranging from about 2 inches to about 2 feet, but is typicality between about 2 inches and 1 foot in depth, for example, about 3.25 inches in depth.

As disclosed herein, embodiments of the invention, in their many aspects, provide systems, devices, and methods for introducing a stream of drying air to articles, for example, articles of clothing, for instance, foot wear (for example, ski boots, snowboard boots, shoes, boots, work boots, sneakers, skates, cleats, soccer boots, socks, and the like); hand wear (for example, gloves, work gloves, ski gloves, hockey gloves, mittens, and the like); over coats (for example, ski wear, parkas, jackets, leg wear (for example, pants, ski pants, trousers, and the like); and other clothes or garments to dry the article and, for example, facilitate further use. Aspects of the invention may be adapted for use in firehouses, for example, to dry firemen's boots. Aspects of the invention may also be adapted for use by athletes, for example, in locker rooms, for instance, hockey locker rooms, for drying hockey gloves, hockey skates, and other gear, or in football locker rooms to dry footwear, helmets, and other gear. Aspects of the invention may be uniquely adapted to drying winter clothing, in particular, after a day on the skiing or sledding, but other aspects of the invention may be used for drying any form of clothing, including damp swim wear and beach towels. In addition to residential or resort use, aspects of the invention may also be used in commercial and/or industrial applications where the drying of articles, for example, fabrics, work gear, or manufactured articles is desired.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. An apparel drying assembly comprising:

a vertically oriented panel having an internal passage;

a plurality of projections, each of the plurality of projections pivotally mounted to the vertically oriented panel, and having an inlet in fluid communication with the internal passage of the panel, at least one outlet, an internal passage communicating the inlet to the at least one outlet, and positionable in to at least one position adapted to receive an apparel;

a source of pressurized air having an outlet in fluid communication with the internal passage of the panel;

a valve element in the vertically oriented panel, the valve element positioned adjacent the inlet of at least one of the plurality of projections, and the valve element at least partially obstructing flow of pressurized air to the inlet of the at least one of the plurality of projections;

wherein the at least one of the plurality of projections further comprises an extension positioned to contact and deflect the valve element when the at least one of the plurality of projections is pivotally rotated to at least partially reduce the obstructing of flow of pressurized air to the inlet of the at least one of the plurality of projections; and wherein the pressurized air from the source of pressurized air passes through the internal passage of the panel, passed the valve element, into the inlet, through the internal passage, and out the at least one outlet of the at least one of the plurality of projections to contact and at least partially dry the apparel received by the at least one of the plurality of projections.

2. The apparel drying assembly as recited in claim 1, wherein the extension of the at least one of the plurality of projections comprises an extension located at a distal end of the at least one of the plurality of projections.

3. The apparel drying assembly as recited in claim 1, wherein the extension of the at least one of the plurality of projections comprises at least one of an extension of the pivotally mounted projection, a projection, a tab, a pin, a rod, and a bar.

4. The apparel drying assembly as recited in claim 1, wherein the valve element comprises at least one of a bar, a plate, a baffle, and a flap.

5. The apparel drying assembly as recited in claim 1, wherein the valve element comprises a reed valve.

6. The apparel drying assembly as recited in claim 1, wherein each of the pivotally mounted plurality of projections is pivotally mounted to the vertically oriented panel with a pin.

7. The apparel drying assembly as recited in claim 1, wherein each of the pivotally mounted plurality of projections is pivotally mounted to the vertically oriented panel with a biasing element.

8. The apparel drying assembly as recited in claim 7, wherein the biasing element comprises a spring.

9. The apparel drying assembly as recited in claim 1, wherein the assembly further comprises a retaining device configured to assist in retaining a position of at least one of the plurality of projections.

10. The apparel drying assembly as recited in claim 9, wherein the retaining device comprises a touch latch.

* * * * *